US007444971B2

(12) United States Patent
Suga et al.

(10) Patent No.: US 7,444,971 B2
(45) **Date of Patent: *Nov. 4, 2008**

(54) VALVE TIMING CONTROL APPARATUS OF INTERNAL COMBUSTION ENGINE

(75) Inventors: Seiji Suga, Kanagawa (JP); Tomoya Tsukada, Kanagawa (JP)

(73) Assignee: Hitachi, Ltd.

( * ) Notice: Subject to any disclaimer, the term of this patent is extended or adjusted under 35 U.S.C. 154(b) by 0 days.

This patent is subject to a terminal disclaimer.

(21) Appl. No.: 11/703,645

(22) Filed: Feb. 8, 2007

(65) Prior Publication Data

US 2007/0251475 A1 Nov. 1, 2007

(30) Foreign Application Priority Data

Apr. 28, 2006 (JP) ..... 2006-124955

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31

See application file for complete search history.

(56) References Cited

U.S. PATENT DOCUMENTS

2006/0086332 A1 * 4/2006 Simpson et al. ..... 123/90.17
2007/0101962 A1 5/2007 Tsukada et al.

FOREIGN PATENT DOCUMENTS

EP 1 533 484 A2 5/2005
JP 2005-147153 A 6/2005

* cited by examiner

*Primary Examiner*—Zelalem Eshete
(74) *Attorney, Agent, or Firm*—Antonelli, Terry, Stout & Kraus, LLP.

(57) ABSTRACT

A valve timing control apparatus is adapted to an exhaust valve side of an internal combustion engine. A vane member is arranged to rotate with a camshaft relative to a timing sprocket member. The vane member is rotated at low speed engine operation dominantly by a camshaft-torque actuation mechanism and at high speed engine operation dominantly by a hydraulic actuation mechanism. The camshaft-torque actuation mechanism is actuated by an alternating torque of the camshaft, whereas the hydraulic actuation mechanism is actuated by a fluid pump. The camshaft-torque actuation mechanism and hydraulic actuation mechanism are controlled independently of each other.

23 Claims, 11 Drawing Sheets

VALVE TIMING CONTROL APPARATUS OF INTERNAL COMBUSTION ENGINE

BACKGROUND OF THE INVENTION

The present invention relates generally to a valve timing control (VTC) apparatus for controlling valve timings of an internal combustion engine such as opening and closing timings of engine valves such as intake and exhaust valves, and more particularly to a valve timing control apparatus which actuates a phase alteration mechanism with an alternating torque of a camshaft and a hydraulic pressure.

A Japanese Patent Application Publication No. 2005-147153 (henceforth referred to as "JP2005-147153") shows a camshaft phasing device or valve timing control apparatus of a vane type, which employs: a cam torque actuated (CTA) phaser or camshaft-torque actuation mechanism to rotate a vane member with fluctuations of an alternating torque of a camshaft as a driving source; and an oil pressure actuated (OPA) phaser or hydraulic actuation mechanism to rotate the vane member with a discharge pressure of an oil pump as a driving source.

Specifically, in the conventional valve timing control apparatus, a cylindrical housing is closed at its front open end by a front cover and is closed at its rear open end by a rear cover. A vane member including a plurality of CTA vanes and a plurality of OPA vanes is rotatably disposed within the housing. The CTA vanes are driven in one rotational direction by fluctuations of the alternating torque of a camshaft, whereas the OPA vanes are driven in the opposite rotational direction by the discharge pressure of the oil pump. The vane member is coupled at its central portion to an end of a camshaft, such as an exhaust camshaft.

The housing is formed with a plurality of shoes in the inside peripheral surface. Each of the vanes of the vane member and the shoes of the housing define an advance fluid pressure chamber and a retard fluid pressure chamber. A solenoid-type control valve is disposed slidably within the vane member to supply and drain an oil pressurized by the oil pump to and from the fluid pressure chambers.

The CTA vanes are rotated in one rotational direction by the camshaft-torque actuation mechanism including the control valve when the discharge pressure of the oil pump is low, for example, at the time of engine start or at the time of low speed engine operation, whereas the OPA vanes are rotated in the opposite rotational direction by the hydraulic actuation mechanism when the discharge pressure of the oil pump is high, for example, at the time of high speed engine operation.

The vane member is rotated in normal and reverse directions by the alternating torque and the hydraulic pressure, resulting in an alteration in the valve timing phase or the relative rotational phase of the camshaft with respect to a timing pulley. Thus, the opening and closing timings of each exhaust valve is controlled in accordance with the engine operating conditions.

SUMMARY OF THE INVENTION

In the above-mentioned valve timing control apparatus of JP2005-147153, the fluid pressure of the advance and retard fluid pressure chambers of the camshaft-torque actuation mechanism and hydraulic actuation mechanism are controlled by the single control valve. Accordingly, in the hydraulic actuation mechanism, in order to advance the relative rotational phase, oil is supplied to the advance fluid pressure chamber, while oil is drained from the retard fluid pressure chamber to outside. On the other hand, in order to retard the relative rotational phase, oil is drained from both of the advance and retard fluid pressure chambers to outside.

On the other hand, the camshaft-torque actuation mechanism of the above valve timing control apparatus is substantially inoperative at the time of high speed engine operation, because the alternating torque transmitted from the camshaft relatively decreases to be low in frequency and magnitude at the time of high speed engine operation.

Thus, the camshaft-torque actuation mechanism functions insufficiently at the time of high speed engine operation. Further, the hydraulic actuation mechanism is low in dynamic responsiveness during retarding the relative rotational phase, because the retarding is implemented by draining the oil from both of the advance and retard fluid pressure chambers.

Accordingly, it is an object of the present invention to provide a valve timing control apparatus of an internal combustion engine which is capable of functioning sufficiently under every condition.

According to one aspect of the present invention, a valve timing control apparatus for an internal combustion engine, comprises: a driving rotator adapted to be rotated by a torque outputted from the internal combustion engine; a driven rotator arranged to rotate with a relative rotational phase with respect to the driving rotator and adapted to transmit the torque from the driving rotator to a camshaft of the internal combustion engine via working fluid in a torque transmission path; a camshaft-torque actuation mechanism including at least a first camshaft-torque actuation chamber and a second camshaft-torque actuation chamber arranged in the torque transmission path, the camshaft-torque actuation mechanism being configured to alter the relative rotational phase by providing selectively at least a state of allowing a unidirectional flow of working fluid from the first camshaft-torque actuation chamber to the second camshaft-torque actuation chamber and a state of allowing a unidirectional flow of working fluid from the second camshaft-torque actuation chamber to the first camshaft-torque actuation chamber; a hydraulic actuation mechanism including at least a first hydraulic actuation chamber and a second hydraulic actuation chamber arranged in the torque transmission path, the hydraulic actuation mechanism being configured to alter the relative rotational phase by providing selectively at least a state of supplying working fluid to the first hydraulic actuation chamber from outside and draining working fluid from the second hydraulic actuation chamber to outside and a state of supplying working fluid to the second hydraulic actuation chamber from outside and draining working fluid from the first hydraulic actuation chamber to outside; and a working fluid control section for controlling the camshaft-torque actuation mechanism and the hydraulic actuation mechanism.

According to another aspect of the invention, a valve timing control apparatus for an internal combustion engine, comprises: a driving rotator adapted to be rotated by a torque outputted from the internal combustion engine; a driven rotator arranged to rotate with a relative rotational phase with respect to the driving rotator and adapted to transmit the torque from the driving rotator to a camshaft of the internal combustion engine via working fluid in a torque transmission path; at least a first camshaft-torque actuation chamber and a second camshaft-torque actuation chamber arranged in the torque transmission path; a camshaft-torque actuation control valve configured to alter the relative rotational phase by providing selectively at least a state of allowing a unidirectional flow of working fluid from the first camshaft-torque actuation chamber to the second camshaft-torque actuation chamber and a state of allowing a unidirectional flow of working fluid from the second camshaft-torque actuation chamber to the first camshaft-torque actuation chamber; at least a first hydraulic actuation chamber and a second hydraulic actuation chamber arranged in the torque transmission path; a hydraulic actuation control valve configured to alter the relative rotational phase by providing selectively at least a state of supplying working fluid to the first hydraulic actuation chamber from outside and draining working fluid from the second hydraulic actuation chamber to outside and a state of supplying working fluid to the second hydraulic actuation chamber from outside and draining working fluid from the first hydraulic actuation chamber to outside; and a controller for controlling the camshaft-torque actuation control valve and the hydraulic actuation control valve independently of each other.

DETAILED DESCRIPTION OF THE INVENTION

Figure 1:
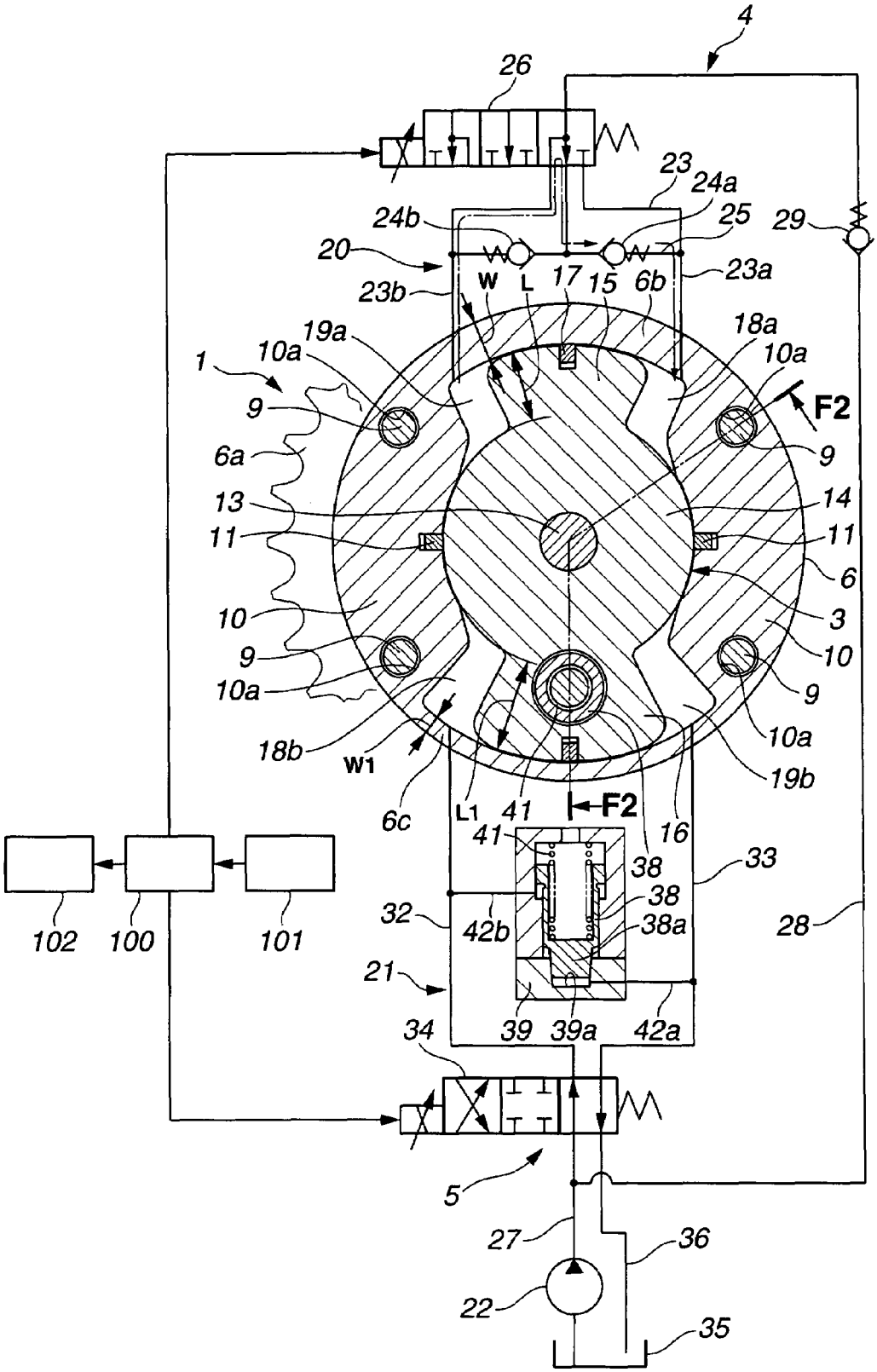
FIG. 1 is a sectional view taken along a line F1-F1 in FIG. 2, showing a valve timing control apparatus of an internal combustion engine in accordance with a first embodiment of the present invention.
Figure 2:
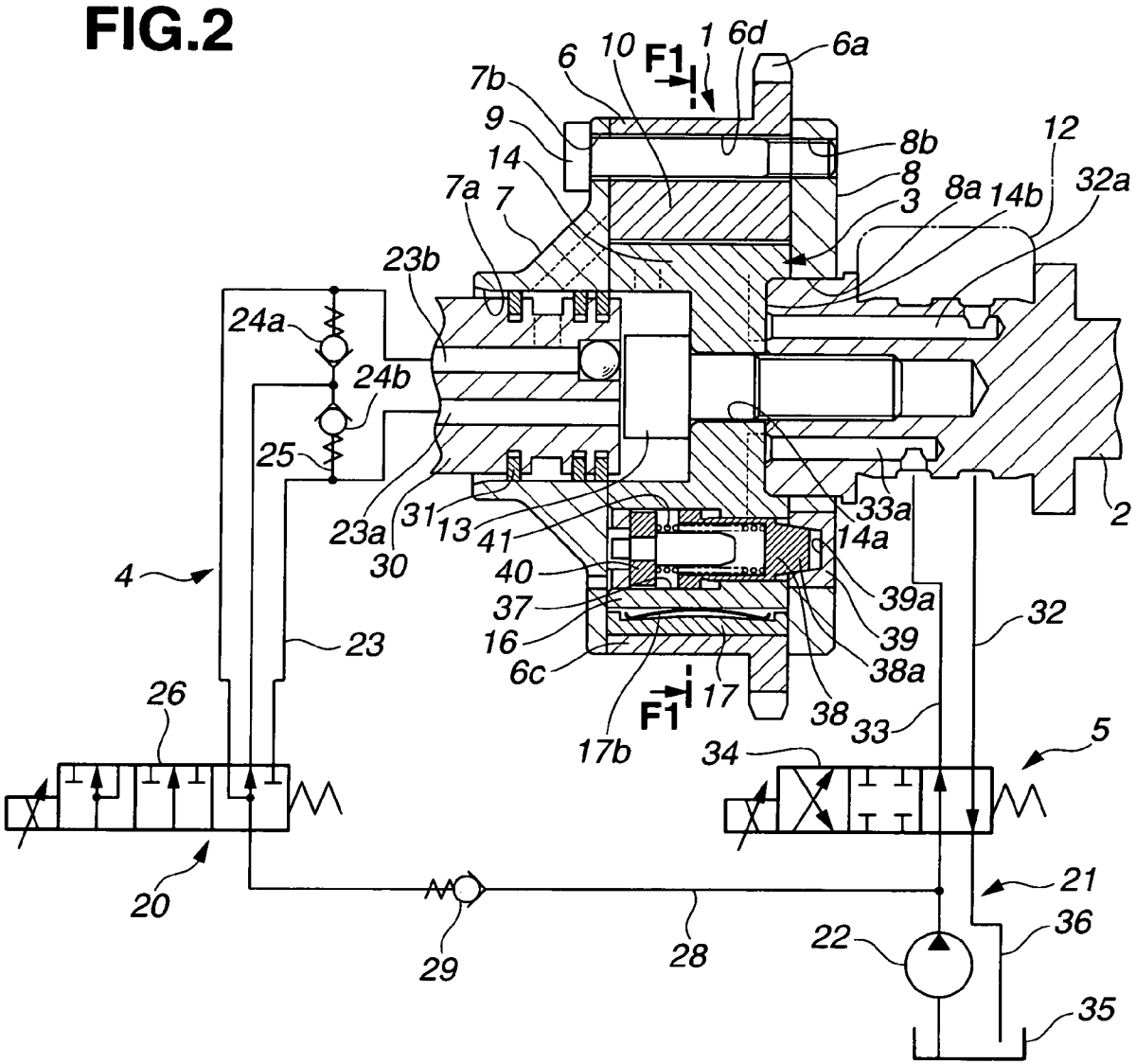
FIG. 2 is a sectional view taken along a line F2-F2 in FIG. 1, showing the valve timing control apparatus of FIG. 1.

FIG. 1 shows a valve timing control apparatus or system of an internal combustion engine in accordance with a first embodiment of the present invention. FIG. 2 shows the valve timing control apparatus in section taken along a line F2-F2 in FIG. 1 whereas FIG. 1 is a sectional view taken along a line F1-F1 shown in FIG. 2. The valve timing control apparatus of this embodiment is adapted to an exhaust valve side of the internal combustion engine.

A timing sprocket member 1 is a driving rotator which is rotated by a torque outputted from the internal combustion engine and specifically driven through a timing chain by a crankshaft of the internal combustion engine. A camshaft 2 is rotatable relative to sprocket member 1. A vane member 3 is a driven rotator which is arranged to rotate with a relative rotational phase with respect to the driving rotator and adapted to transmit the torque from the driving rotator to camshaft 2 via working fluid in a torque transmission path, and specifically fixed at an end of camshaft 2 so that they rotate as a unit, and which is encased rotatably in sprocket member 1. A camshaft-torque actuation (or cam torque actuated, CTA) mechanism 4 is configured to allow the vane member 3 to rotate in one rotational direction in timing sprocket member 1 by means of an alternating torque transmitted from camshaft 2. A hydraulic actuation (or oil pressure actuated, OPA) mechanism 5 is configured to rotate the vane member 3 in the other rotational direction within timing sprocket member 1 by means of a hydraulic pressure.

Timing sprocket member 1 includes a sprocket housing 6, a front cover 7 and a rear cover 8 which are joined together by fastening devices which, in this example, are four small-diameter bolts 9. Housing 6 is a hollow cylindrical member extending axially from a front open end to a rear open end. Housing 6 includes a toothed portion 6*a* formed integrally on the periphery of housing 6, and arranged to engage in links of the timing chain. Vane member 3 is enclosed rotatably in housing 5. Front cover 7 is in the form of a circular disk, and arranged to close the front open end of housing 6. Rear cover 8 is in the form of an approximately circular disk and arranged to close the rear open end of housing 6. Front cover 7, housing 6 and rear cover 8 are joined together to form a housing encasing the vane member 3, by the above-mentioned bolts 9 extending in the axial direction of the camshaft.

Housing 6 is approximately in the form of a hollow cylinder open at both ends. Housing 6 includes a plurality of partitions 10 projecting radially inwards from an inside circumferential wall surface of cylindrical housing 6. Projecting partitions 10 serve as housing shoes. In this example, the number of shoes 10 is two, and these two shoes 10 are arranged at angular intervals of approximately 180°. Housing 6 includes arced portions 6*b* and 6*c* of the periphery of different thicknesses arranged between shoes 10 and 10. Arced portion 6*b* located at an upper position of housing 6 in FIG. 1 has a thickness W whereas arced portion 6*c* located at a lower position of housing 6 has a thickness W1 greater than thickness W.

Each shoe 10 extends axially from the front open end to the rear open end of housing 6, and has an approximately trapezoidal cross section as viewed in FIG. 1. In this example, housing 6 includes a front end surface which is substantially flat and which is joined with front cover 7, and a rear end surface which is substantially flat and which is joined with rear cover 8. Each shoe 10 of this example includes a front end surface which is flat, and flush and continuous with the flat front end surface of housing 6, and a rear end surface which is flat, and flush and continuous with the flat rear end surface of housing 6. Two bolt holes 10*a* are formed in each shoe 10. Each bolt hole 10*a* passes axially through one of shoes 10, and receives one of the axially extending bolts 9. Each shoe 10 includes an inner end surface which is sloping in conformity with the outer shape of a later-mentioned vane rotor (14) of vane member 3. A retaining groove extends axially in the form of cutout in the inner end surface of each shoe at a substantially middle position. A U-shaped seal member 11 is fit in each retaining groove, and urged radially inwards by a leaf spring (not shown) fit in the retaining groove.

Front cover 7 is in the form of a circular disk including a central portion extending axially outwards, including a center retainer hole 7*a* having a relatively large inside diameter, and four bolt holes 7*b* each located at a peripheral position corresponding to one of bolt holes 6*d* of housing 6 receiving one of the axially extending bolts 9.

Rear cover 8 is in the form of a circular plate, including a center bearing hole 8*a* having a relatively large inside diameter and passing axially through rear cover 8. Rear cover 8 includes four threaded holes 8*b* arranged in the periphery into which the four bolts 9 are screwed, respectively.

Camshaft 2 is rotatably supported through a cam bearing and bearing bracket 12 on an upper portion of a cylinder head of the engine. Camshaft 2 includes one or more cams formed integrally on the outer circumference of camshaft 2 at predetermined positions. Each cam is arranged to open an exhaust valve of the engine through a valve lifter.

Vane member 3 of this example is a jointless single member made of sintered alloy. Vane member 3 includes a central vane rotor 14 and a plurality of vanes projecting radially outwards. In this example, the number of vanes is two, and first and second vanes 15 and 16 are arranged at angular intervals of approximately 180° circumferentially around vane rotor 14 and each formed in a sectoral shape. Vane rotor 14 is annular and includes a center bolt hole 14*a* at the center. Vane member 3 is fixed to a front end of camshaft 2 by a cam bolt 13 extending axially through the center bolt hole 14*a*.

Vane rotor 14 has an axial length substantially identical to the inside axial length of housing 6 so that the front end surface and rear end surface of vane rotor 14 are supported in sliding contact on opposed inside surfaces of front cover 7 and rear cover 8, respectively. Vane rotor 14 includes an annular fit hole 14*b* at the center of the front end. A front end portion of camshaft 2 is fit in fit hole 14*b*.

First and second vanes 15 and 16 are unequal in a radial length measured in the radial direction toward a common center axis of a rotary mechanism composed of vane member 3 and timing sprocket 1. The radial length of each vane is defined in accordance with the thickness of the wall of housing 6. First vane 15 is a smaller vane having a smaller radial length L in accordance with the thickness of arced portion 6*b*, whereas second vane 16 is a larger vane having a larger radial length L1 greater than L in accordance with the thickness of arced portion 6*c*.

Second vane 16 has a circumferential width greater than first vane 15. A part of a below-described lock mechanism is provided arranged axially within second vane 16.

First and second vanes 15 and 16 and the two shoes 10 of timing sprocket member 1 are arranged alternately in the circumferential direction around the center axis, as shown in FIG. 1. Namely, each vane 15 or 16 is located circumferentially between adjacent two of the shoes 10. Each vane 15 or 16 includes a retaining groove receiving a U-shaped seal member 17 in sliding contact with the inside cylindrical surface of housing 6, and a leaf spring 17*a* for urging the seal member 17 radially outward and thereby pressing the seal member 17 to the inside cylindrical surface of housing 6. Each retaining groove is formed substantially at a middle of an outer end of the associated vane. A first advance fluid pressure chamber 18*a* and a first retard fluid pressure chamber 19*a* are formed on both sides of first vane 15. First advance fluid pressure chamber 18*a* is defined between one side surface of first vane 15 and the adjacent shoe 10 to which the one side surface faces. First retard fluid pressure chamber 19*a* is defined between the other side surface of first vane 15 and the adjacent shoe 10 to which the other side surface faces. A second advance fluid pressure chamber 18*b* and a second retard fluid pressure chamber 19*b* are formed on both sides of second vane 16. Second advance fluid pressure chamber 18*b* is defined between one side surface of second vane 16 and the adjacent shoe 10 to which the one side surface faces. Second retard fluid pressure chamber 19*b* is defined between the other side surface of second vane 16 and the adjacent shoe 10 to which the other side surface faces. First advance fluid pressure chamber 18*a* and first retard fluid pressure chamber 19*a* serve as camshaft-torque actuation chambers. Second advance fluid pressure chamber 18*b* and second retard fluid pressure chamber 19*b* serve as hydraulic actuation chambers.

Thus, the total volumetric capacity of first advance fluid pressure chamber 18*a* and first retard fluid pressure chamber 19*a* is smaller than that of second advance fluid pressure chamber 18*b* and second retard fluid pressure chamber 19*b*.

Camshaft-torque actuation mechanism 4 includes first vane 15, first advance fluid pressure chamber 18*a*, first retard fluid pressure chamber 19*a*, and a first hydraulic circuit 20 configured to control a flow of working fluid between first advance fluid pressure chamber 18*a* and first retard fluid pressure chamber 19*a*.

Hydraulic actuation mechanism 5 includes second vane 16, second advance fluid pressure chamber 18*b*, second retard fluid pressure chamber 19*b*, and a second hydraulic circuit 21 configured to supply and drain selectively a fluid pressure of working fluid to and from each of second advance fluid pressure chamber 18*b* and second retard fluid pressure chamber 19*b*.

First hydraulic circuit 20 includes a communication passage 23 connecting first advance fluid pressure chamber 18*a* and first retard fluid pressure chamber 19*a* to each other; a bypass passage 25 arranged in parallel with communication passage 23; and a first directional control valve (camshaft-torque actuation control valve) 26 arranged to vary a state of communication in communication passage 23 among first advance fluid pressure chamber 18*a*, first retard fluid pressure chamber 19*a* and a below-described replenishing passage 28. A first check valve 24*a* and a second check valve 24*b* are provided in bypass passage 25 in order to restrict the flow of working fluid as opposed unidirectional flows. A point in bypass passage 25 between first check valve 24*a* and second check valve 24*b* is hydraulically connected to first directional control valve 26. The working fluid is supplied to bypass passage 25 via the point when first directional control valve 26 is so controlled. First directional control valve 26 serves as a first working fluid control section for controlling the camshaft-torque actuation mechanism 4.

Communication passage 23 is connected via first directional control valve 26 to a replenishing passage 28 branched from a main gallery 27 connected to a fluid pump, such as an oil pump 22. A third check valve 29 is provided in replenishing passage 28 to provide a unidirectional flow of working fluid from main gallery 27 to communication passage 23. Replenishing passage 28, when the working fluid leaks from first advance fluid pressure chamber 18*a* and first retard fluid pressure chamber 19*a*, serves to supply working fluid to them from oil pump 22. Replenishing passage 28 and third check valve 29 serves as a replenishing mechanism.

Communication passage 23 allows the working fluid to flow from first advance fluid pressure chamber 18*a* to first retard fluid pressure chamber 19*a*, or allows the working fluid to flow from first retard fluid pressure chamber 19*a* to first advance fluid pressure chamber 18*a*, selectively, in accordance with an operational state of first directional control valve 26. As shown in FIG. 2, communication passage 23 includes two passage sections 23*a* and 23*b* formed within a cylindrical fluid passage section 30. Fluid passage section 30 passes though the retainer hole 7*a* of front cover 7. Fluid passage section 30 is formed with oil holes and grooves inside of fluid passage section 30 and on outer peripheral surfaces of fluid passage section 30. Front cover 7 is formed with an inclined oil hole inside. Fluid passage section 30 and vane rotor 14 define a cylindrical fluid chamber therebetween.

Vane rotor 14 is formed with a fluid hole inside. Passage sections 23*a* and 23*b* are connected to first advance fluid pressure chamber 18*a* and first retard fluid pressure chamber 19*a* via the above oil holes, grooves, and chamber. Fluid passage section 30 includes three circumferential grooves on its outer cylindrical surface in each of which a seal ring 31 is fit to seal a portion between retainer hole 7*a* and fluid passage section 30.

First directional control valve 26 of this example is a solenoid valve having three ports and three positions. A valve element inside the first directional control valve 26 is arranged to alter the connection between first advance fluid pressure chamber 18*a* and first retard fluid pressure chamber 19*a*, and to alter the connection between replenishing passage 28 and one of first advance fluid pressure chamber 18*a* and first retard fluid pressure chamber 19*a* to which the working fluid is supplied in order to compensate an amount of working fluid that leaks from first advance fluid pressure chamber 18*a* and first retard fluid pressure chamber 19*a*. The inside spool valve element of first directional control valve 26 is controlled in accordance with a control current outputted by a below-described controller 100 to alter an open/closed state of each port.

Second hydraulic circuit 21 includes an advance communication passage 32 leading to second advance fluid pressure chamber 18*b*; a retard communication passage 33 leading to second retard fluid pressure chamber 19*b*; and a drain passage 36 connected to oil pan 35. A second directional control valve (hydraulic actuation control valve) 34 is arranged as a pressure control valve to connect main gallery 27 to advance communication passage 32 and to retard communication passage 33 selectively, and also arranged to connect oil pan 35 to advance communication passage 32 and to retard communication passage 33 to drain the working fluid from one of second advance fluid pressure chamber 18*b* and second retard fluid pressure chamber 19*b*. Second directional control valve 34 serves as a second working fluid control section for controlling the hydraulic actuation mechanism 5. First directional control valve 26 and second directional control valve 34 are collectively referred to as working fluid control section. The first and second working fluid control sections are configured to operate in respective different control modes.

Advance communication passage 32 and retard communication passage 33 are connected to second advance fluid pressure chamber 18*b* and second retard fluid pressure chamber 19*b* via an advance communication hole 32*a* and a retard communication hole 33*a*, respectively. Advance communication hole 32*a* and retard communication hole 33*a* axially extend inside camshaft 2.

Second directional control valve 34 of this example is a solenoid valve having four ports and three positions. A valve element inside the second directional control valve 34 is arranged to alter the state of connection among main gallery 27, advance communication passage 32, retard communication passage 33 and drain passage 36. The inside spool valve element of second directional control valve 34 is controlled in accordance with a control current outputted by the below-described controller 100 to alter an open/closed state of each port. Thus, according to engine operating conditions, the inside spool valve element of second directional control valve 34 slides to be in a maximally displaced position to connect main gallery 27 to advance communication passage 32 and connect drain passage 36 to retard communication passage 33, or to be in another maximally displaced position to connect main gallery 27 to retard communication passage 33 and connect to drain passage 36 to advance communication passage 32. Further, under predetermined engine operating conditions, for example, at the time of middle speed operation of the engine, second directional control valve 34 is controlled to shut off advance communication passage 32 and retard communication passage 33 from main gallery 27 and drain passage 36 to maintain the state of the working fluid within second advance fluid pressure chamber 18*b* and second retard fluid pressure chamber 19*b*, so that the rotation of vane member 3 is held stationary. At the time of rest of the engine, second directional control valve 34 is in a position to connect retard communication passage 33 to drain passage 36 and shut off advance communication passage 32 from outside.

Controller 100 produces control signals, and controls first directional control valve 26 and second directional control valve 34 by sending the control signals to first directional control valve 26 and second directional control valve 34, respectively. A sensor section 101 collects input information on operating conditions of the engine and a vehicle in which this timing control apparatus is installed. The input information is supplied to controller 100. The sensor section of this example includes a crank angle sensor for sensing a speed of the engine, an air flow meter for sensing an intake air quantity of the engine, other sensors, such as a throttle valve switch and an engine coolant sensor, a crank angle sensor, a cam angle sensor and an input device, such as an ignition switch or a vehicle main switch, to sense a start of the engine. Controller 100 determines a current operating state based on the signals from the sensors, and further determines a relative rotational position between sprocket member 1 and camshaft 2.

A lock mechanism or phase lock mechanism is a mechanism to prevent and allow the relative rotation between the driving rotator that is sprocket member 1 in this example and the driven rotator that is vane member 3 in this example. The lock mechanism is provided between the sprocket member 1 and vane member 3. In this example, the lock mechanism is formed between housing 6 and vane member 3.

As shown in FIGS. 1 and 2, the lock mechanism is provided between rear cover 8 and second vane 16 having the wider width. The lock mechanism includes a lock pin 38 which is slidably received in a slide hole 37 formed in vane member 3. In this example, slide hole 37 is formed extending along the axial direction of camshaft 2 inside the second vane 16. Lock pin 38 is a cup-shaped member in the form of a hollow cylinder having one end closed. A tapered forward end portion of lock pin 38 is housed in or released from a lock recess 39*a* formed in a lock recess section 39. Lock recess section 39 is fixed in a fixing hole formed in rear cover 8. Lock recess section 39 is a hollow cup-shaped member to form lock recess 39*a*. A spring retainer 40 is fixed on the bottom of slide hole 37. A spring member 41 is retained by spring retainer 40 to urge the lock pin 38 toward lock recess 39*a*.

In a state in which vane member 3 is at a most advanced position, forward end portion 38*a* of lock pin 38 is inserted into lock recess 39*a* to lock the relative rotation between timing sprocket member 1 and camshaft 2. Lock pin 38 includes an outer large-diameter section slidably received in the outer large-diameter portion of slide hole 37; an inner small-diameter section slidably received in the inner small-diameter section of slide hole 37; and an annular step shoulder surface formed between the large-diameter section and the small-diameter section of lock pin 38. The step shoulder surface of lock pin 38 and slide hole 37 define a chamber, to which the working fluid is supplied from second advance fluid pressure chamber 18*b* and second retard fluid pressure chamber 19*b* via a fluid hole 42*a* and a fluid hole 42*b*. The supplied fluid pressure presses the lock pin 38 back from lock recess 39*a* to release the lock state of the lock mechanism.

The above-constructed valve timing control apparatus is operated as follows. At the time of rest of the engine, controller 100 inhibits supplying the control current to first directional control valve 26 and second directional control valve 34, so that the spool valve element of first directional control valve 26 is displaced by the action of the spring to allow the working fluid to flow from first retard fluid pressure chamber 19*a* into first advance fluid pressure chamber 18*a* via communication passage 23. On the other hand, the spool valve element of second directional control valve 34 is urged in one direction by the action of the spring to connect the retard communication passage 33 to drain passage 36 and to shut off the advance communication passage 32. Accordingly, the working fluid is drained from second retard fluid pressure chamber 19*b* to decompress the second retard fluid pressure chamber 19*b*, whereas no working fluid is supplied to second advance fluid pressure chamber 18*b*.

As a result of the above, vane member 3 rotates counterclockwise in FIG. 1 by means of an alternating torque of camshaft 2 caused just before the engine is completely stopped, especially by means of the positive torque component of the alternating torque. The alternating torque is a form of a twisting energy caused from the reaction force acted on each valve spring. At this time, the working fluid flows from first retard fluid pressure chamber 19*a* into first advance fluid pressure chamber 18*a* via communication passage 23 as shown by a dotted line in FIG. 1. As a result, vane member 3 is brought into a state in which second vane 16 having the wider width is in contact with a surface of one of the shoes 10 facing the second retard fluid pressure chamber 19*b*; the relative rotational phase of camshaft 2 with respect to timing sprocket member 1 is advanced quickly.

At the time of rest of the engine, forward end portion 38*a* of lock pin 38 is fit in lock recess 39*a*, preventing relative rotation between timing sprocket member 1 and camshaft 2, and thus fixing the relative rotational phase of camshaft 2 with respect to timing sprocket member 1 at the most advanced position.

When the engine is started and brought into low speed conditions such as idle conditions, controller 100 produces a control signal so that first directional control valve 26 operates to allow the working fluid to flow from first retard fluid pressure chamber 19*a* into first advance fluid pressure chamber 18*a* via communication passage 23 and first check valve 24*a*. At this time, vane member 3 is rotated counterclockwise in FIG. 1 and held there by means of the positive component of the alternating torque of camshaft 2.

At the same time, second directional control valve 34 is energized to connect the second retard fluid pressure chamber 19*b* to drain passage 36 and to connect the second advance fluid pressure chamber 18*b* to main gallery 27. Accordingly, the working fluid is drained from second retard fluid pressure chamber 19*b* to decompress the second retard fluid pressure chamber 19*b*, whereas the working fluid is supplied to second advance fluid pressure chamber 18*b* from oil pump 22. The discharge pressure of oil pump 22 is however not enough high at this time. As a result, vane member 3 is held at an advanced rotational position by means of the alternating torque of camshaft 2, namely by camshaft-torque actuation mechanism 4.

In the above state, the relative rotational angle of camshaft 2 relative to timing sprocket member 1 is held at the most advanced position. Thus, the opening and closing timings of the exhaust valve is advanced so that the valve overlap with the intake valve is relatively small, resulting in improving the combustion efficiency by utilizing inertial intake air, in improving the engine cranking performance, and in stabilizing the idling operation.

At the time of low speed operation of the engine, the discharge pressure of oil pump 22 is relatively small and thereby the fluid pressure supplied to lock recess 39*a* is relatively small. Accordingly, lock pin 38 is held in lock recess 39*a*.

The lock mechanism in the lock state can prevent vibrations or flapping of vane member 3 due to alternating torque of camshaft 2 between the positive and negative sides to prevent abnormal sounds in the engine starting operation.

When after the above the vehicle starts to run to enter a predetermined middle or high speed operation region, controller 100 produces a control signal so that first directional control valve 26 controls communication passage 23 to allow the working fluid to flow from first advance fluid pressure chamber 18*a* to first retard fluid pressure chamber 19*a*. At the same time, second directional control valve 34 connects the second advance fluid pressure chamber 18*b* to drain passage 36 via advance communication passage 32 and connects the second retard fluid pressure chamber 19*b* to main gallery 27 via retard communication passage 33.

As a result of the above, the internal pressure of second advance fluid pressure chamber 18*b* is reduced whereas the internal pressure of second retard fluid pressure chamber 19*b* is enhanced by supplying the highly pressurized discharge pressure from oil pump 22 to second retard fluid pressure chamber 19*b*.

As the fluid pressure of second retard fluid pressure chamber 19*b* increases rapidly, lock pin 38 is moved back from lock recess 39*a* against the force of the spring, resulting in ensuring free rotation of vane member 3.

When the internal pressure of second retard fluid pressure chamber 19*b* is high, vane member 3 rotates clockwise maximally in FIG. 1 so that the relative rotational phase of camshaft 2 with respect to timing sprocket member 1 is altered to the most retarded position. Since the alternating torque of camshaft 2 is relatively small at this time, vane member 3 is rotated maximally on the retard side by the high fluid pressure of oil pump 22.

In the above state, the relative rotational angle of camshaft 2 relative to timing sprocket member 1 is held at the most retarded position. Thus, the opening and closing timings of the exhaust valve are retarded so that the valve overlap with the intake valve is relatively large, resulting in improving the intake efficiency and in enhancing the output power of the engine.

When vane member 3 rotates clockwise in the above process, the working fluid flows from first advance fluid pressure chamber 18*a* into first retard fluid pressure chamber 19*a* via communication passage 23 and second check valve 24*b*. As a result, the rotation of vane member 3 is rapidly achieved without receiving a flow resistance.

When the engine is in a predetermined operation region from low speed to high speed, second directional control valve 34 receives a control signal from controller 100 and shuts off both of advance communication passage 32 and retard communication passage 33 by means of the spool valve. Thus, vane member 3 is held at a desired rotational position, maintaining the corresponding relative rotational phase against disturbances such as the alternating torque transmitted from camshaft 2.

The above-constructed valve timing control apparatus is effective for suitably varying the opening/closing timing of the exhaust valve in accordance with the engine operating conditions in order to exhibit the full engine performance, and also for enhancing the response of the relative rotational phase of camshaft 2 with respect to timing sprocket member 1 because it is possible to actively supply working fluid by second directional control valve 34 selectively to second advance fluid pressure chamber 18*b* or to second retard fluid pressure chamber 19*b* both for advancing operation and for retarding operation.

Further, it is possible to control precisely camshaft-torque actuation mechanism 4 and hydraulic actuation mechanism 5, because the working fluid of camshaft-torque actuation mechanism 4 and hydraulic actuation mechanism 5 are independently controlled by first directional control valve 26 and second directional control valve 34, respectively. As a result, it is possible to control precisely the relative rotational phase of camshaft 2 with respect to timing sprocket member 1.

Moreover, first directional control valve 26 and second directional control valve 34 are provided separately, and may be arranged in any separate positions in the cylinder head. This improves the flexibility of layout and the mountability to the engine.

The above-constructed valve timing control apparatus is also effective for enhancing the response of the normal and reverse rotation of vane member 3 to the action of the working fluid at the time of low pressure operation of the pump such as at the time of start of the engine and at the time of low speed operation of the engine since the radial length of first vane 15 is shorter than that of second vane 16 so that the volumetric capacity of first advance fluid pressure chamber 18*a* and first retard fluid pressure chamber 19*a* is smaller than that of second advance fluid pressure chamber 18*b* and second retard fluid pressure chamber 19*b*.

The construction that the radial length of first vane 15 is relatively short, results in that the inertial mass of first vane 15 is relatively small and the volumetric capacity of first advance fluid pressure chamber 18*a* and first retard fluid pressure chamber 19*a* is relatively small, and thereby results in enhancing the mobility of the working fluid between first advance fluid pressure chamber 18*a* and first retard fluid pressure chamber 19*a*. Accordingly, at the time of idling operation or low speed operation of the engine, camshaft-torque actuation mechanism 4 rotates the vane member 3 to the advance side with improved dynamic responsiveness.

On the other hand, the construction that the radial length of second vane 16 is relatively long enough, results in that the second vane 16 has an enough area for receiving the pressure of the working fluid of second retard fluid pressure chamber 19*b*, and results in that in the middle and high speed region of the engine, second vane 16 can effectively receive the high discharge pressure of oil pump 22. Accordingly, hydraulic actuation mechanism 5 rotates the vane member 3 with improved dynamic responsiveness.

Therefore the valve timing control apparatus of this example can alter the relative rotational phase of camshaft 2 with respect to timing sprocket member 1 with improved dynamic responsiveness both at the time of high pressure operation of oil pump 22 and at the time of low pressure operation of oil pump 22.

Further, the valve timing control apparatus, wherein the lock mechanism is capable of reliably restricting the rotation of vane member 3 at the time of rest or ultra low speed operation of the engine, is effective for prevent vibrations or flapping and abnormal sounds of vane member 3 due to alternating torque of camshaft 2 at engine start.

The mechanical structure of the valve timing control apparatus of the present embodiment may be constructed based on a basic structure and generally by maintaining the outside diameter of housing 6, increasing the thickness of arced portion 6*b*, and reducing the radial length of first vane 15. Accordingly, in order to obtain the valve timing control apparatus of this embodiment, it is unnecessary to increase the whole size larger than the basic structure, and to change a major structure of the basic structure. This minimizes the manufacturing cost of the valve timing control apparatus.

When the working fluid flows between first advance fluid pressure chamber 18*a* and first retard fluid pressure chamber 19*a*, the working fluid is supplied from oil pump 22 via replenishing passage 28 and third check valve 29 to first advance fluid pressure chamber 18*a* and first retard fluid pressure chamber 19*a*. This is effective for preventing that air enters first advance fluid pressure chamber 18*a* and first retard fluid pressure chamber 19*a*. This is also effective for preventing the dynamic responsiveness of vane member 3 from decreasing.

The provision of third check valve 29 prevents the working fluid from flowing reversely in replenishing passage 28 under conditions, such as at the time of rest of the engine, and thereby prevents the dynamic responsiveness of camshaft-torque actuation mechanism 4 at the time of start of the engine from decreasing.

The construction that the clearance between the front and rear surfaces of vane rotor 14 and first vane 15 and the inside surface of front cover 7 and rear cover 8 is reduced as small as possible, is effective for preventing the working fluid from leaking from first advance fluid pressure chamber 18*a* and first retard fluid pressure chamber 19*a*. As a result, vane member 3 is rotated by camshaft-torque actuation mechanism 4 with improved dynamic responsiveness. A seal device may be provided between the front and rear surfaces of vane rotor 14 and first vane 15 and the inside surface of front cover 7 and rear cover 8 in order to enhance the sealing performance. The foregoing effect is relatively large for camshaft-torque actuation mechanism 4 since the volumetric capacity of the camshaft-torque actuation chambers is relatively small.

Further, the construction that the working fluid can directly flow between first advance fluid pressure chamber 18*a* and first retard fluid pressure chamber 19*a*, is effective for enhancing the response of normal and reverse rotation of vane member 3 to the alternating torque.

The construction that camshaft-torque actuation mechanism 4 and hydraulic actuation mechanism 5 are both operative at a time, the relative rotational phase of camshaft 2 with respect to timing sprocket member 1 is altered with improved dynamic responsiveness.

In this example, oil pump 22 is also arranged to supply a lubricating oil to lubricate the engine. Accordingly, it is unnecessary to provide a special fluid pump for the valve timing control apparatus. This minimizes increase in the manufacturing cost. When the engine is in the middle and high speed operation region, the quantity of discharge of the pump is large and the advancing operation is carried out with improved dynamic responsiveness.

In this embodiment, at the time of rest of the engine, vane member 3 is rotated to the most advanced position by the alternating torque transmitted from camshaft 2, enhancing the engine cranking performance.

First directional control valve 26 and second directional control valve 34 may be controlled differently. If first directional control valve 26 is held to communicate constantly between first advance fluid pressure chamber 18*a* and first retard fluid pressure chamber 19*a*, and second directional control valve 34 is controlled actively, it is possible to alter the relative rotational phase only by second directional control valve 34. Conversely, if second directional control valve 34 is held to connect constantly second advance fluid pressure chamber 18*b* and second retard fluid pressure chamber 19*b* to drain passage 36, and first directional control valve 26 is controlled actively, it is possible to alter the relative rotational phase only by first directional control valve 26.

Figure 3:
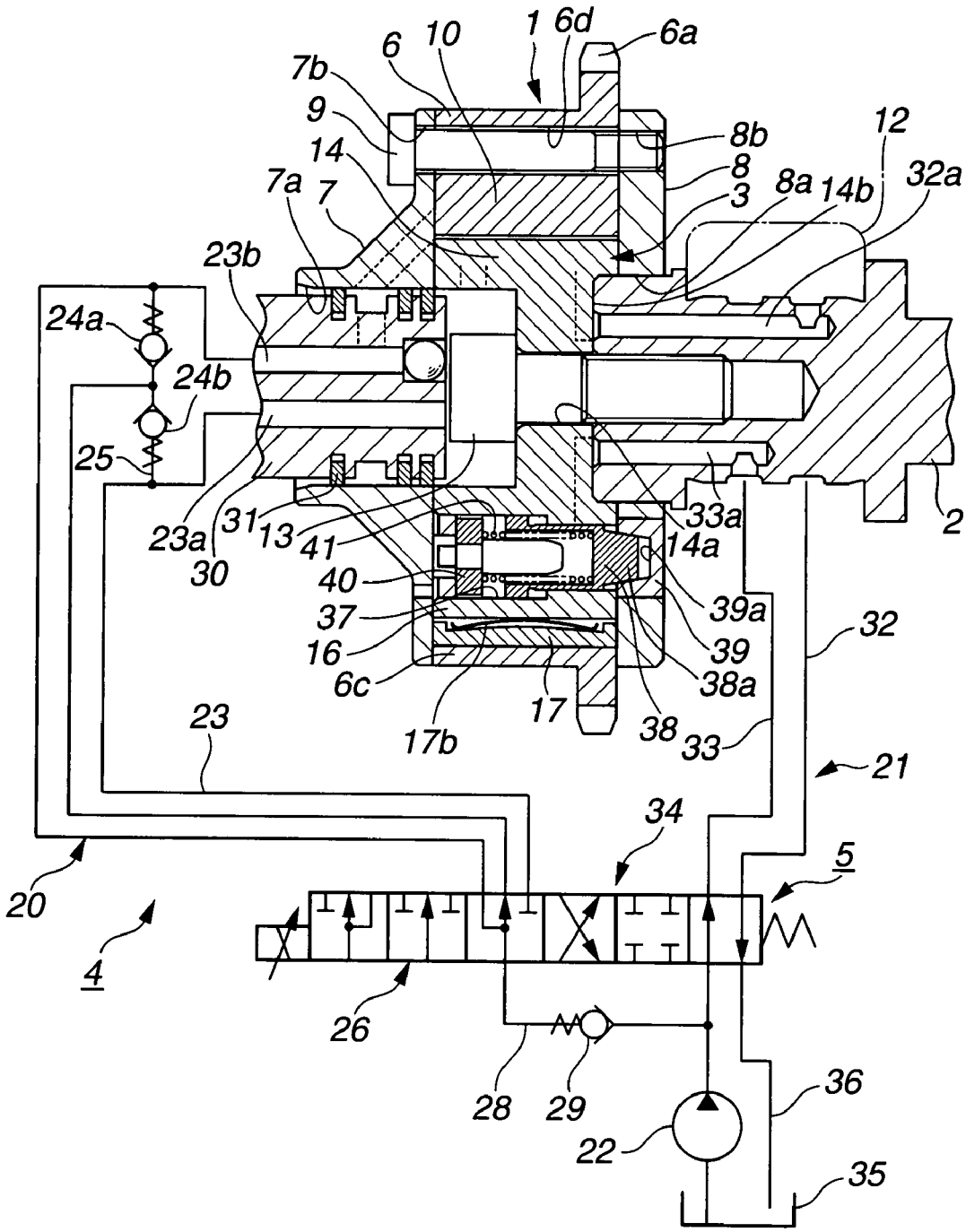
FIG. 3 is a sectional view showing a valve timing control apparatus of an internal combustion engine in accordance with a second embodiment of the present invention.

FIG. 3 shows a valve timing control apparatus of an internal combustion engine in accordance with a second embodiment of the present invention. In this example, first directional control valve 26 and second directional control valve 34 are arranged in series in the longitudinal direction and provided as a unit. The operation of first directional control valve 26 and second directional control valve 34, and the remaining part of the valve timing control apparatus are the same as in the first embodiment.

The valve timing control apparatus of the second embodiment is effective similarly as in the first embodiment, and is effective further for simplifying the layout of the pipes of first hydraulic circuit 20 and second hydraulic circuit 21.

Figure 4:
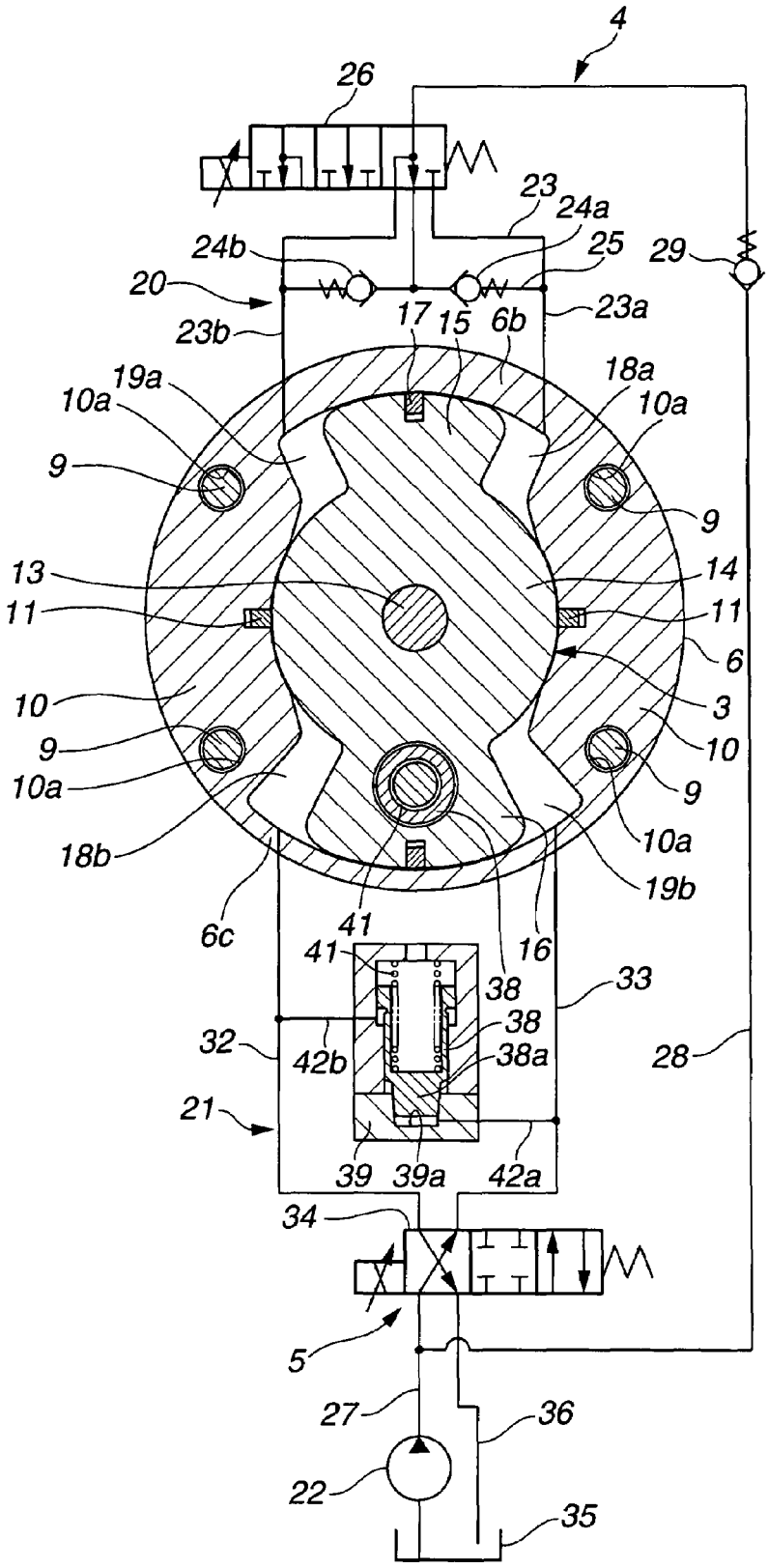
FIG. 4 is a sectional view showing a valve timing control apparatus of an internal combustion engine in accordance with a third embodiment of the present invention.

FIG. 4 shows a valve timing control apparatus of an internal combustion engine in accordance with a third embodiment of the present invention. In this example, according to the engine operating conditions, controller 100 controls each of camshaft-torque actuation mechanism 4 and hydraulic actuation mechanism 5 in a normal control mode or another different control mode.

Specifically, in the normal control mode, first directional control valve 26 and second directional control valve 34 operate similarly as in the first embodiment. For example, when the engine is in a state just prior to stop or in low speed operation, first directional control valve 26 moves the inside spool valve to the most left side in FIG. 4 to allow the working fluid to flow from first retard fluid pressure chamber 19*a* into first advance fluid pressure chamber 18*a*, to rotate vane member 3 counterclockwise in FIG. 4, and to alter the relative rotational phase of camshaft 2 with respect to timing sprocket member 1 to the most advanced position. On the other hand, for example, second directional control valve 34 allows the working fluid to flow from fluid pump 22 to second retard fluid pressure chamber 19*b* to impose a torque on vane member 3 clockwise.

Figure 5:
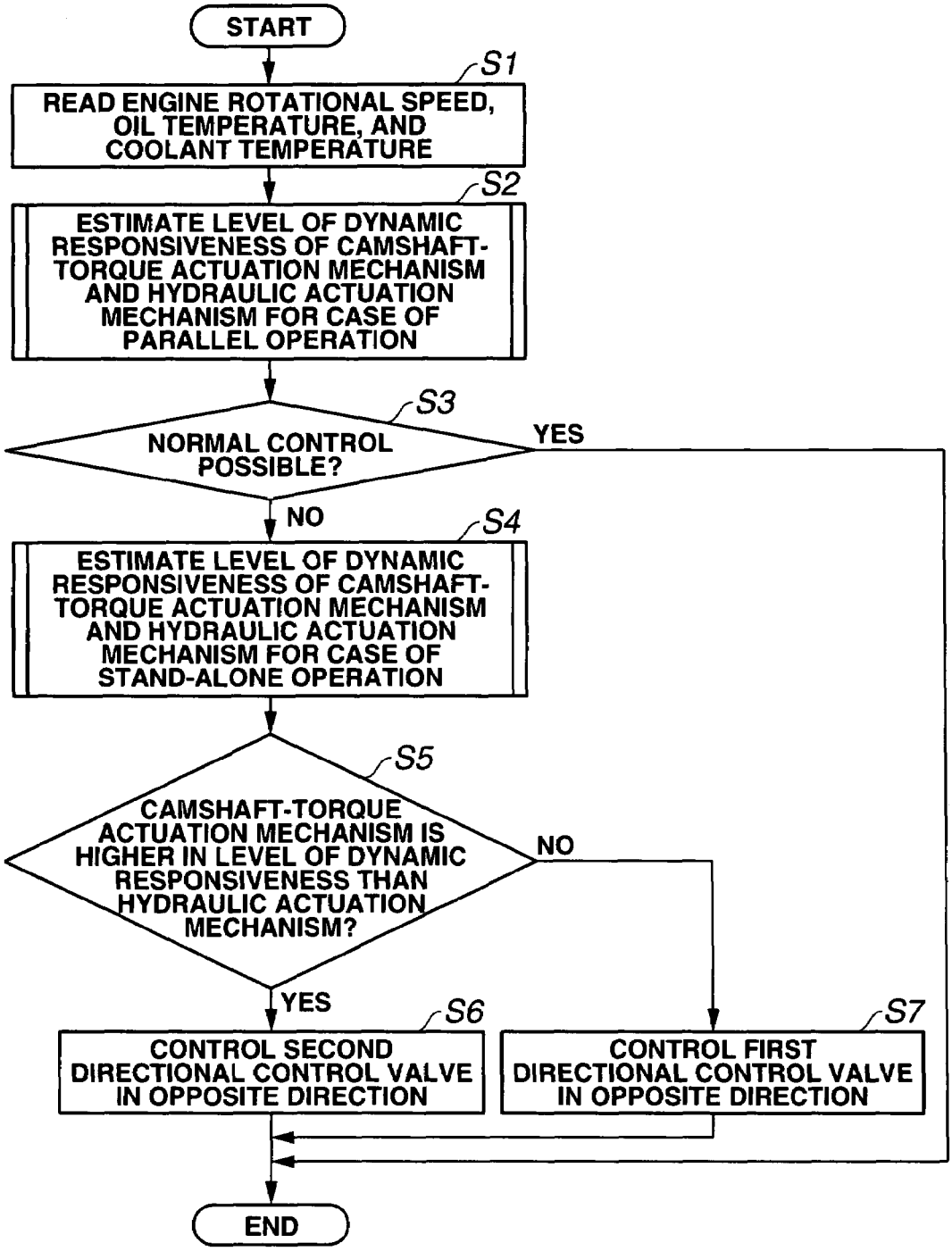
FIG. 5 is a flow chart showing a control process to be performed by the valve timing control apparatus.

FIG. 5 shows a flow chart showing a control process performed by controller 100. First, at step S1, controller 100 reads the current value of engine rotational speed, lubricating oil temperature and coolant temperature.

At step S2, controller 100 estimates or computes the level of dynamic responsiveness of camshaft-torque actuation mechanism 4 and hydraulic actuation mechanism 5 for the case where camshaft-torque actuation mechanism 4 and hydraulic actuation mechanism 5 are both operated actively, on the basis of the signals from the crank angle sensor and/or the cam angle sensor.

At step S3, controller 100 judges whether or not it is possible to control normally camshaft-torque actuation mechanism 4 and hydraulic actuation mechanism 5. When the answer to step S3 is affirmative (YES), the routine returns. On the other hand, when the answer to step S3 is negative (NO), the routine proceeds to step S4.

At step S4, controller 100 estimates or computes the level of dynamic responsiveness of camshaft-torque actuation mechanism 4 and hydraulic actuation mechanism 5 for the case where only one of camshaft-torque actuation mechanism 4 and hydraulic actuation mechanism 5 is operated actively. At step S5, controller 100 determines whether or not the level of dynamic responsiveness of camshaft-torque actuation mechanism 4 is higher than that of hydraulic actuation mechanism 5. When the answer to step S4 is YES, the routine proceeds to step S6. On the other hand, when the answer to step S4 is NO, the routine proceeds to step S7.

At step S6, controller 100 controls second directional control valve 34 to move in the opposite direction to the normal direction. That is, in order to produce a torque in the opposite direction to the direction of rotation of camshaft-torque actuation mechanism 4, the spool valve of second directional control valve 34 is controlled to supply the working fluid to second retard fluid pressure chamber 19*b*.

Thus, the torque imposed on vane member 3 by the operation of camshaft-torque actuation mechanism 4 is reduced by the resisting torque imposed by hydraulic actuation mechanism 5. This prevents rapid rotation of vane member 3.

On the other hand, at step S7, controller 100 controls first directional control valve 26 to move in the opposite direction to the normal direction, in order to prevent rapid rotation of vane member 3.

Thus, first directional control valve 26 is configured to operate in a first control mode to control the camshaft-torque actuation mechanism 4 to generate a first torque to alter the relative rotational phase in a first rotational direction, and second directional control valve 34 is configured to control the hydraulic actuation mechanism 5 to generate a second torque to alter the relative rotational phase in a second rotational direction during the first control mode of first directional control valve 26, the second torque being different in magnitude than the first torque, and the second rotational direction being opposite to the first rotational direction. First directional control valve 26 is configured to operate in the first control mode at low speed operation of the engine, the first torque being larger than the second torque.

At the time of low speed operation of the engine, it is possible that camshaft-torque actuation mechanism 4 operates quickly to rotate rapidly vane member 3 counterclockwise, because the magnitude of the alternating torque transmitted from camshaft 2 is relatively large. The operation in which second directional control valve 34 is controlled to generate a torque to alter the relative rotational phase in the opposite direction, serves to provide a resistance against the operation of camshaft-torque actuation mechanism 4, and thereby prevents rapid rotation of vane member 3.

Thus, it is possible to control slowly the relative rotational phase of camshaft 2 with respect to timing sprocket member 1 at the time of various engine operations such as at the time of low speed operation of the engine, because rapid normal and reverse rotation of vane member 3 is prevented by operation according to the engine operation.

Figure 6:
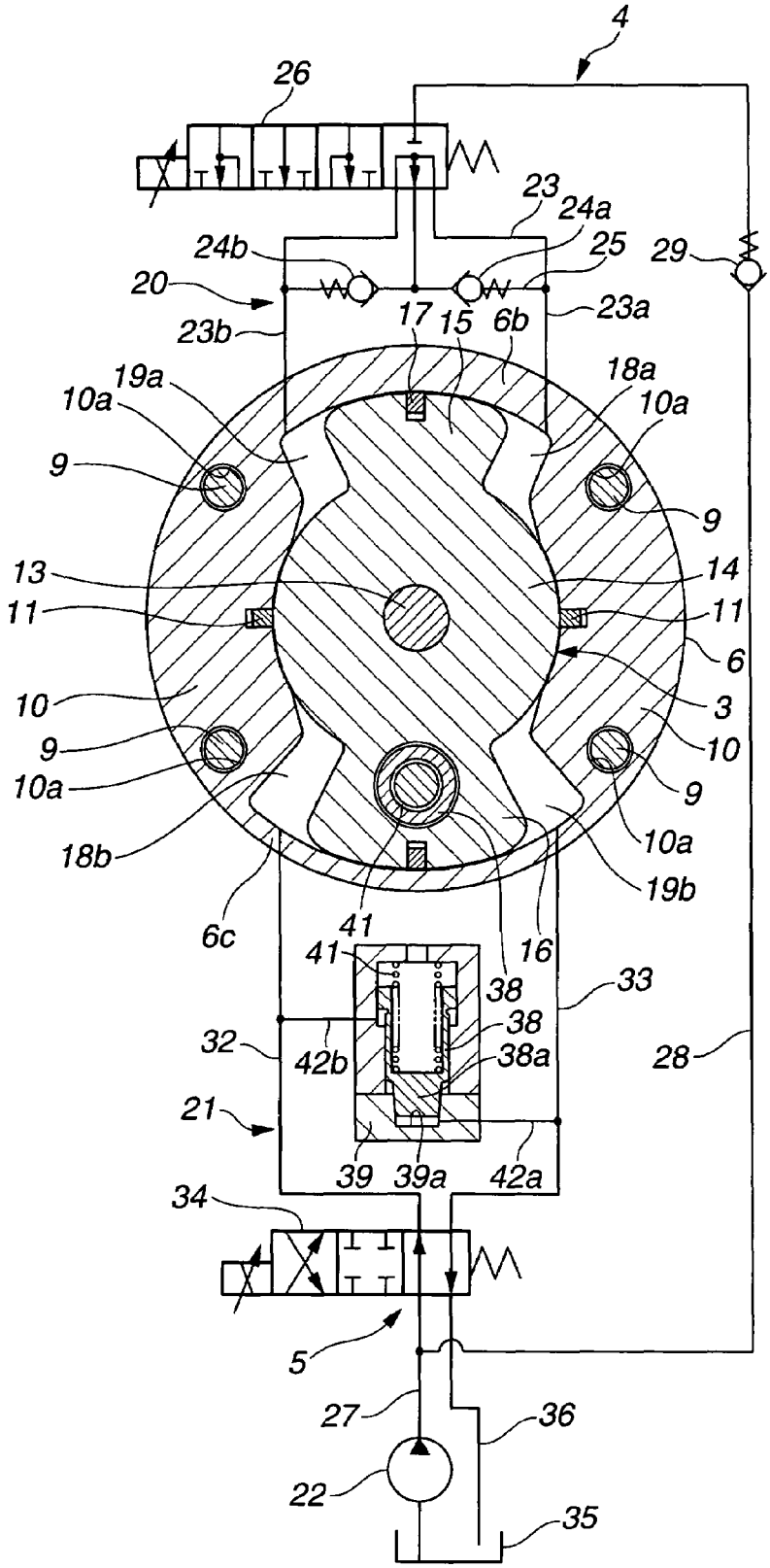
FIG. 6 is a sectional view showing a valve timing control apparatus of an internal combustion engine in accordance with a fourth embodiment of the present invention.

FIG. 6 shows a valve timing control apparatus of an internal combustion engine in accordance with a fourth embodiment of the present invention. In this embodiment, first directional control valve 26 is modified to be in the form of a four-position type.

Specifically, first directional control valve 26 is controlled to be in one of a state of allowing a unidirectional flow of the working fluid from first advance fluid pressure chamber 18*a* to first retard fluid pressure chamber 19*a*, a state of allowing a unidirectional flow of the working fluid from first retard fluid pressure chamber 19*a* to first advance fluid pressure chamber 18*a*, a state shutting off fluid communication between first advance fluid pressure chamber 18*a* and first retard fluid pressure chamber 19*a*, and a state of allowing bidirectional flow between first advance fluid pressure chamber 18*a* and first retard fluid pressure chamber 19*a*.

In this embodiment, controller 100 is configured to control the relative rotational phase of camshaft 2 with respect to timing sprocket member 1 by feedback control. Specifically, second directional control valve 34 is controlled by feedback control, while first directional control valve 26 is held to be in the state of allowing bidirectional flow between first advance fluid pressure chamber 18*a* and first retard fluid pressure chamber 19*a*.

According to this embodiment, it is possible to control the relative rotational phase only by second directional control valve 34.

In order to implement a feedback control for the valve timing control apparatus by both of first directional control valve 26 and second directional control valve 34, it is appropriate to synchronize substantially completely first directional control valve 26 with second directional control valve 34. According to this embodiment, however, the feedback control is relatively easy because second directional control valve 34 is actively controlled and first directional control valve 26 is held unchanged.

Figure 7:
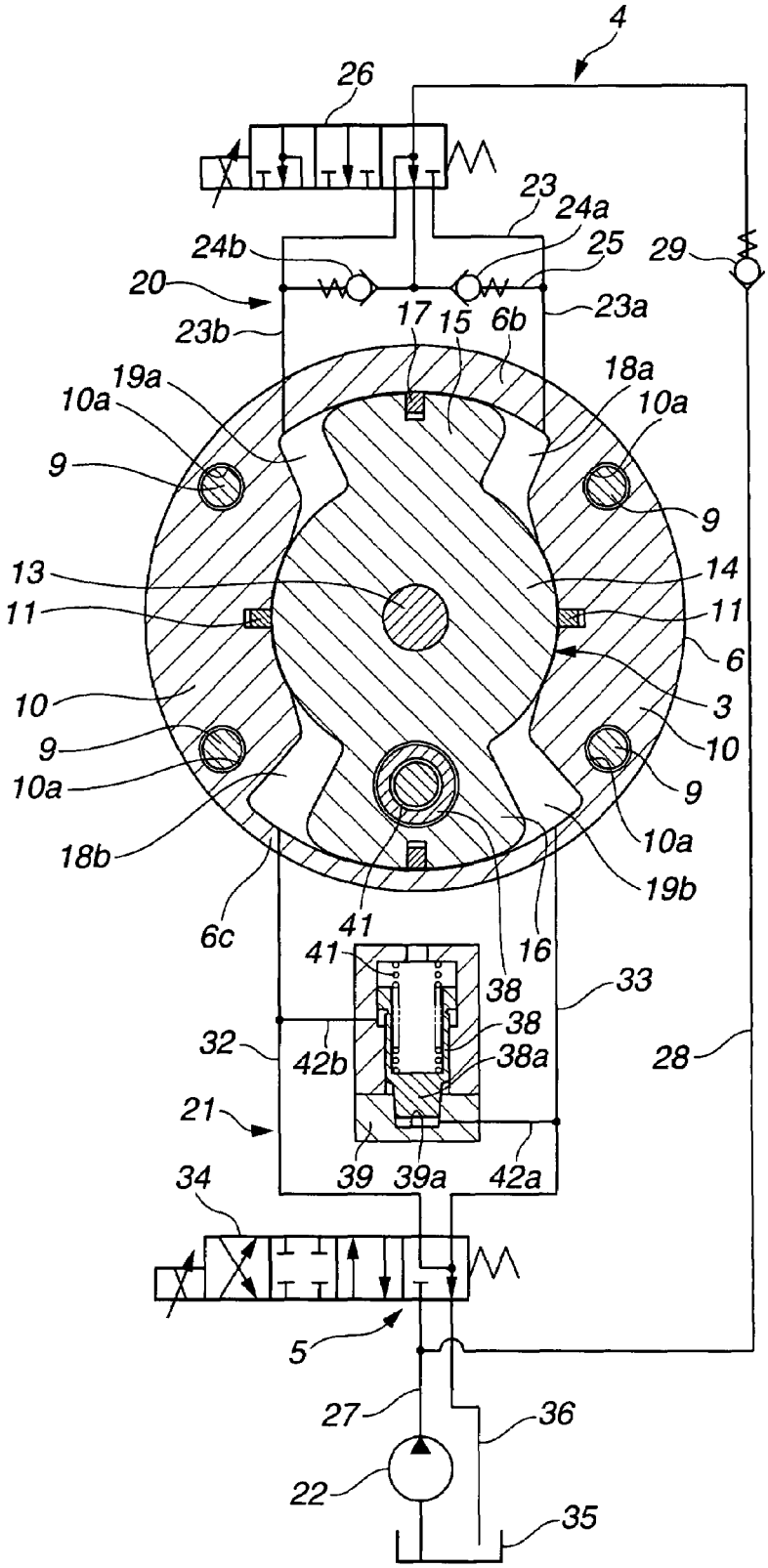
FIG. 7 is a sectional view showing a valve timing control apparatus of an internal combustion engine in accordance with a fifth embodiment of the present invention.

FIG. 7 shows a valve timing control apparatus of an internal combustion engine in accordance with a fifth embodiment of the present invention. In this embodiment, second directional control valve 34 is modified to be in the form of a five-position type.

Specifically, second directional control valve 34 is controlled to be in one of a state of supplying working fluid from fluid pump 22 to second advance fluid pressure chamber 18*b* and draining working fluid from second retard fluid pressure chamber 19*b* to oil pan 35 via drain passage 36, a state of supplying working fluid from fluid pump 22 to second retard fluid pressure chamber 19*b* and draining working fluid from second advance fluid pressure chamber 18*b* to oil pan 35 via drain passage 36, a state shutting off the flow of working fluid of second advance fluid pressure chamber 18*b* and second retard fluid pressure chamber 19*b*, and a state of draining working fluid from both of second advance fluid pressure chamber 18*b* and second retard fluid pressure chamber 19*b*.

In this embodiment, controller 100 is configured to control the relative rotational phase of camshaft 2 with respect to timing sprocket member 1 by feedback control. Specifically, first directional control valve 26 is controlled by feedback control, while second directional control valve 34 is held to be in the state of draining working fluid from both of second advance fluid pressure chamber 18*b* and second retard fluid pressure chamber 19*b*.

As in the fourth embodiment, in order to implement a feedback control for the valve timing control apparatus by both of first directional control valve 26 and second directional control valve 34, it is appropriate to synchronize substantially completely first directional control valve 26 with second directional control valve 34. According to this embodiment, however, the feedback control is relatively easy because first directional control valve 26 is actively controlled and second directional control valve 34 is held unchanged.

Figure 8:
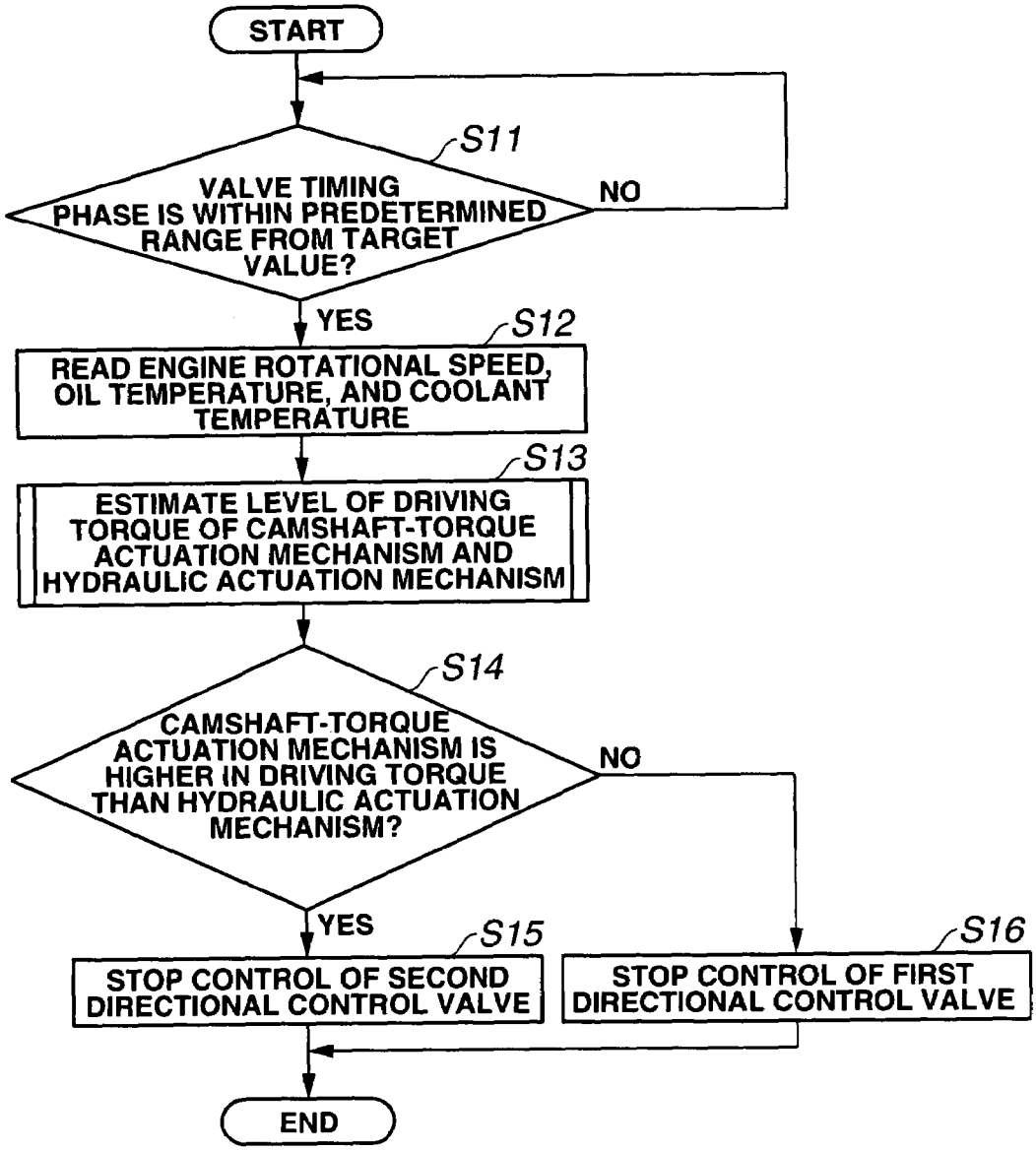
FIG. 8 is a flow chart showing a control process to be performed by the valve timing control apparatus of FIG. 6 or FIG. 7.

FIG. 8 shows a flow chart showing a control process based on feedback control in the fourth and fifth embodiments.

First, at step S11, controller 100 determines whether or not the current value of the relative rotational phase of camshaft 2 with respect to timing sprocket member 1 is within a predetermined range from a target value. When the answer to step S11 is YES, the routine proceeds to step S12. On the other hand, when the answer to step S11 is NO, the routine returns.

At step S12, controller 100 reads the current value of engine rotational speed, lubricating oil temperature and coolant temperature, and estimates or determines the temperature of the body of the engine.

At step S13, controller 100 estimates or computes the level of driving torque of camshaft-torque actuation mechanism 4 and hydraulic actuation mechanism 5. Then, the routine proceeds to step S14.

At step S14, controller 100 determines whether or not the level of driving torque of camshaft-torque actuation mechanism 4 is higher than that of hydraulic actuation mechanism 5. When the answer to step S14 is YES, the routine proceeds to step S15. On the other hand, when the answer to step S14 is NO, the routine proceeds to step S16.

At step S15, controller 100 suspends the control of second directional control valve 34 and controls the relative rotational phase only by first directional control valve 26.

On the other hand, at step S16, controller 100 suspends the control of first directional control valve 26 and controls the relative rotational phase only by second directional control valve 34.

According to the foregoing control process, it is easy to implement a feedback control of the valve timing control apparatus, because only one of camshaft-torque actuation mechanism 4 and hydraulic actuation mechanism 5 is selected and controlled according to the level of driving torque of camshaft-torque actuation mechanism 4 and hydraulic actuation mechanism 5.

Figure 9:
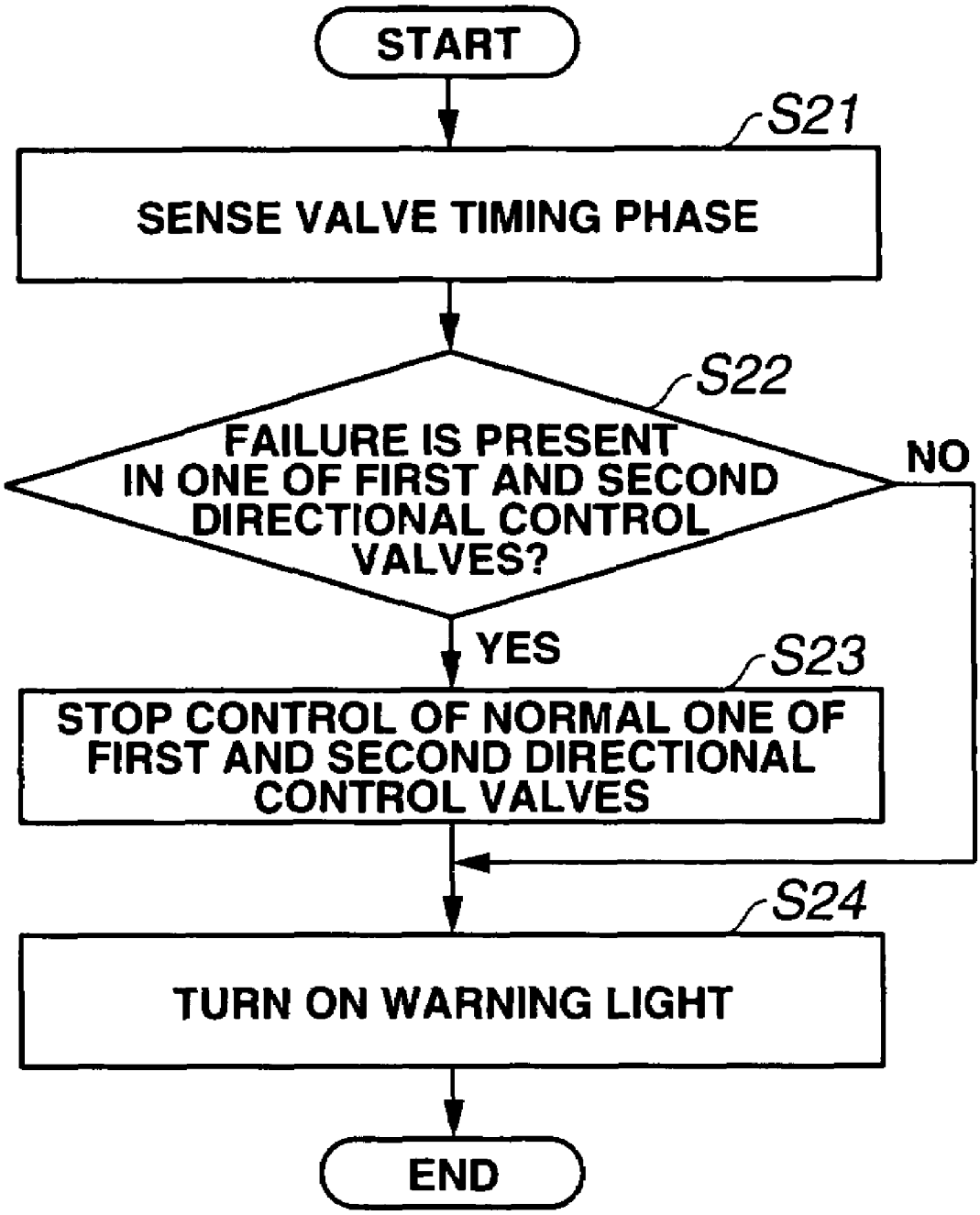
FIG. 9 is a flow chart showing a control process to be performed by a valve timing control apparatus of an internal combustion engine in accordance with a sixth embodiment of the present invention.

FIG. 9 shows a flow chart showing a control process for a valve timing control apparatus of an internal combustion engine in accordance with a sixth embodiment of the present invention, for the case where a failure occurs in one of first directional control valve 26 and second directional control valve 34. It is noted that, while first directional control valve 26 and second directional control valve 34 are being de-energized, the relative rotational phase is returned back to a phase value allowing the internal combustion engine to start. In this embodiment, the valve timing control apparatus further comprises a warning device for providing warning information when a failure occurs in one of first directional control valve 26 and second directional control valve 34. Further, first directional control valve 26 is configured to be de-energized when a failure occurs in second directional control valve 34, and wherein second directional control valve 34 is configured to be de-energized when a failure occurs in first directional control valve 26. First, at step S21, controller 100 senses or determines the current value of the relative rotational phase of camshaft 2 with respect to timing sprocket member 1 on the basis of the sensing signals from the crank angle sensor and the cam angle sensor.

At step S22, controller 100 judges whether or not a failure is present in the valve timing control apparatus, on the basis of data concerning the relative rotational phase. Specifically, controller 100 determines whether or not a failure is present in first directional control valve 26 and second directional control valve 34. When the answer to step S22 is YES, the routine proceeds to step S23. On the other hand, when the answer to step S22 is NO, the routine terminates.

At step S23, controller 100 confirms that the relative rotational phase is returned back into a state enabling start of the engine, and then stops and suspends the controlling the normal one of first directional control valve 26 and second directional control valve 34. For example, the relative rotational phase is returned back into the state enabling start of the engine by the alternating torque transmitted from camshaft 2.

At step S24, controller 100 informs a driver of the presence of the failure by turning on a warning device such as a warning light 102 which is installed in an instrumental panel of the vehicle.

According to this embodiment, when a failure occurs in one of first directional control valve 26 and second directional control valve 34, the control of the normal one of the directional control valves is stopped after the relative rotational phase is returned back into the state enabling start of the engine. This ensures desired engine cranking performance.

Figure 10:
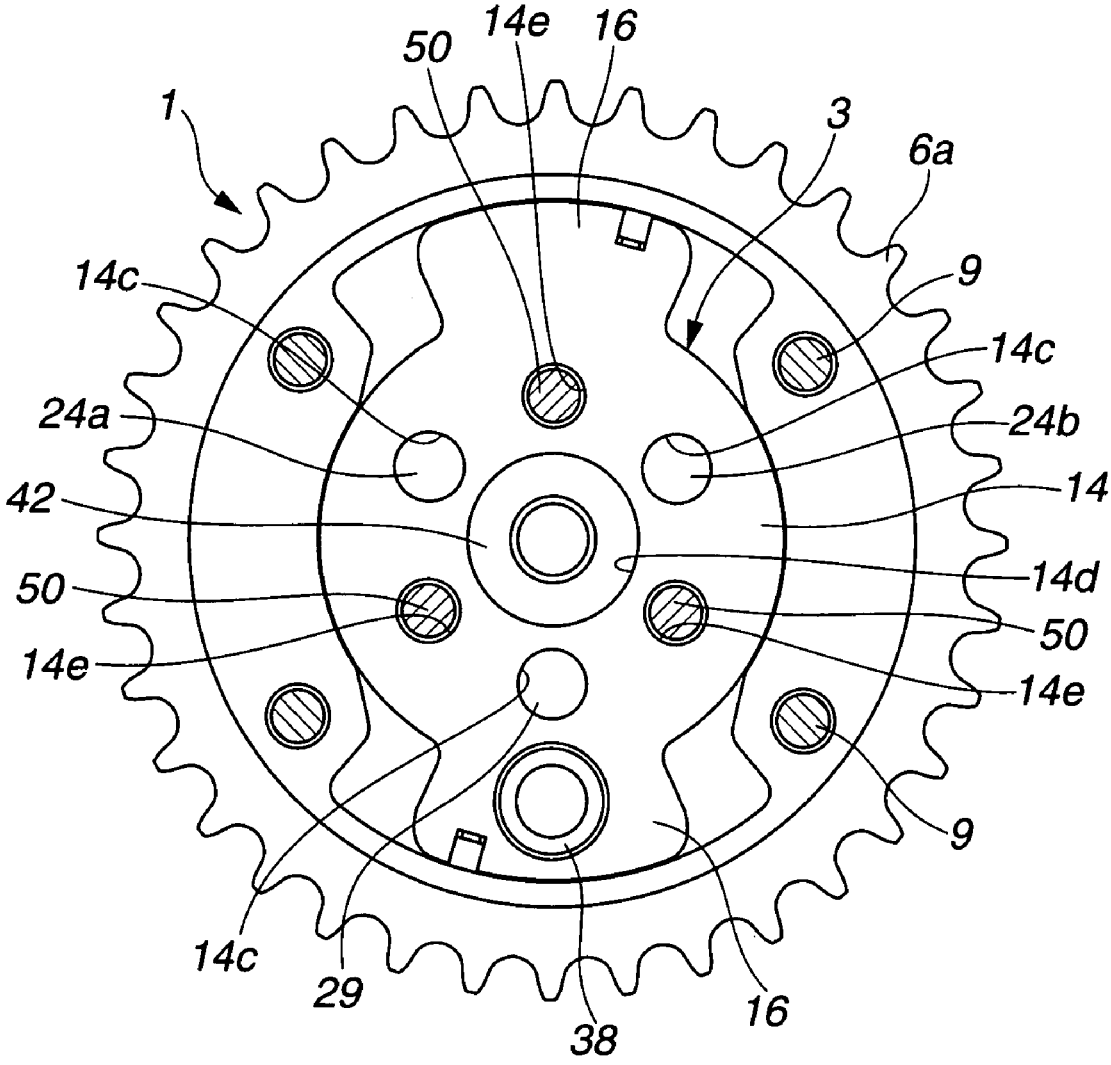
FIG. 10 is a sectional view taken along a line F10-F10 in FIG. 11, showing a valve timing control apparatus of an internal combustion engine in accordance with a seventh embodiment of the present invention.
Figure 11:
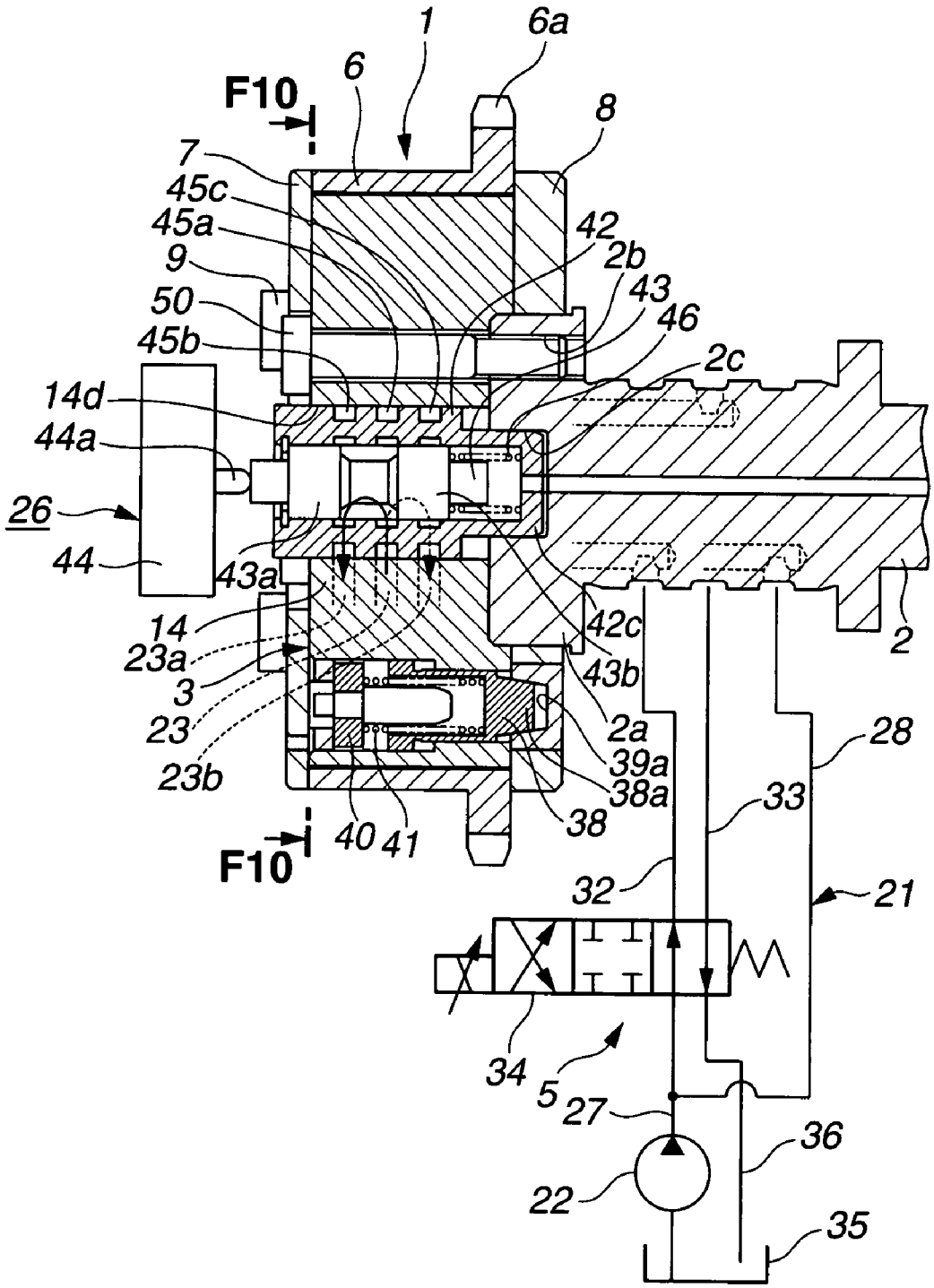
FIG. 11 is a sectional view showing the valve timing control apparatus of FIG. 10.

FIGS. 10 and 11 show a valve timing control apparatus of an internal combustion engine in accordance with a seventh embodiment of the present invention. In this embodiment, camshaft-torque actuation mechanism 4 is modified. First directional control valve 26 is disposed within one of the camshaft and the driven rotator, while second directional control valve 34 is disposed in a position separate from first directional control valve 26. Vane member 3 is secured to camshaft 2 by three bolts, and a passage of the replenishing mechanism, a passage leading to first advance fluid pressure chamber 18*a*, and a passage leading to first retard fluid pressure chamber 19*a*, are arranged alternately with the three bolts in a circumferential direction.

Specifically, camshaft 2 is formed with a flange section 2*a* at the tip, flange section 2*a* having a larger diameter than the other sections of camshaft 2. Flange section 2*a* is formed with threaded holes 2*b* in three positions evenly arranged in the periphery in the circumferential direction, and formed with a cylindrical retainer groove 2*c* in the center of the front surface.

Vane member 3 is formed with a cylindrical retainer hole 14*d* in the center of vane rotor 14, which extends from the front end to the rear end. Vane member 3 is also formed with three bolt insertion holes 14*e* in the corresponding positions to the positions of threaded holes 2*b* of camshaft 2. Three housing holes 14*c* are formed in vane rotor 14, and arranged alternately with the three bolt insertion holes 14*e* in the circumferential direction. Three housing holes 14*c* houses first check valve 24*a*, second check valve 24*b* and third check valve 29, respectively.

Accordingly, vane member 3 is fixed to camshaft 2 by three bolts 50 which are each inserted and screwed into the corresponding threaded hole 2*b* and bolt insertion hole 14*e* from front cover 7.

First directional control valve 26 of camshaft-torque actuation mechanism 4 generally comprises a valve body 42, a spool valve element 43 disposed to slide within valve body 42, and a solenoid 44 for actuating spool valve element 43 to slide. Valve body 42 is in the form of a hollow cylinder with one closed end, and installed and fixed in retainer hole 14*d* of vane rotor 14.

Valve body 42 includes a small-diameter portion 42*c* at the closed bottom end, small-diameter portion 42*c* being formed to fit with retainer groove 2*c*. Valve body 42 is formed with three ports in the cylindrical peripheral wall, the three ports being open to the central passage of communication passage 23, passage section 23*a*, and passage section 23*b*. Each port opens to outside at grooves 45*a*, 45*b* or 45*c* which are formed in the cylindrical peripheral wall of valve body 42.

Spool valve element 43 includes two land portions 43*a* and 43*b* for switching the central passage of the communication passage 23 to be connected to one of passage sections 23*a* and 23*b* via the respective port according to the slide position of spool valve element 43. A spring 46 is installed in a compressed state between one end surface of spool valve element 43 and the bottom of small-diameter portion 42*c* of valve body 4, urging spool valve element 43 toward solenoid 44.

Solenoid 44 accommodates in the body a fixed core, a movable core and an electromagnetic coil which is supplied with a control signal from controller 100. Solenoid 44 further includes a push rod 44*a* for pressing the spool valve element 43 rightward in FIG. 11 against the force of spring 46.

According to this embodiment, when solenoid 44 is energized by controller 100 according to engine operating conditions, spool valve element 43 moves rightward maximally against the force of spring 46, to communicate the central passage of communication passage 23 to passage section 23*a*. This allows a unidirectional flow from first advance fluid pressure chamber 18*a* to first retard fluid pressure chamber 19*a* via second check valve 24*b* as shown by a solid line in FIG. 11.

On the other hand, when solenoid 44 is de-energized, the central passage of communication passage 23 is communicated with passage section 23*b*, to allow a unidirectional flow from first retard fluid pressure chamber 19*a* to first advance fluid pressure chamber 18*a* as shown by a broken line in FIG. 11.

Depending on the value of the current outputted to solenoid 44, spool valve element 43 is held in an intermediate position, allowing bidirectional flow between first advance fluid pressure chamber 18*a* and first retard fluid pressure chamber 19*a*.

According to this embodiment, the operation of first directional control valve 26 provides similar advantageous effects as in the preceding embodiments, while the construction that spool valve element 43 of first directional control valve 26 is installed and retained in vane rotor 14 is effective for preventing the working fluid from leaking to outside. This minimizes adverse effects on the operation due to the leaking, because camshaft-torque actuation mechanism 4 is affected more significantly from the leaking than hydraulic actuation mechanism 5.

Further, the construction that vane rotor 14 accommodates a part of first directional control valve 26, first check valve 24*a*, second check valve 24*b*, and third check valve 29, is effective for reducing the total size and weight of the valve timing control apparatus.

Moreover, the construction that first check valve 24*a*, second check valve 24*b*, third check valve 29 and bolts 50 are arranged in balance in the circumferential direction within vane rotor 14, is effective for improving the total weight balance of vane member 3, and thereby for stabilizing the rotation of vane member 3 because of improved inertia force during rotation and improved structural strength.

The present invention is not limited to the preceding embodiments. Various variations and modifications are possible. For example, the invention may be applied to an intake valve side of the internal combustion engine. In the case of the intake valve side, the valve timing control apparatus is configured such that vane member 3 rotates to the retard side when the engine is at idling. Further, for example, the structure and hydraulic circuit of first directional control valve 26 and second directional control valve 34 may be modified.

The valve timing control apparatus may be configured to start operation of camshaft-torque actuation mechanism 4 prior to hydraulic actuation mechanism 5 when the relative rotational phase is to be altered. Working fluid is drained from one of the hydraulic actuation chambers during operation of hydraulic actuation mechanism 5, whereas working fluid is basically flows within camshaft-torque actuation mechanism 4 under condition of no leaking during operation of camshaft-torque actuation mechanism 4. Accordingly, it is more important to supply working fluid to hydraulic actuation mechanism 5 than to camshaft-torque actuation mechanism 4. Therefore, the starting the operation of camshaft-torque actuation mechanism 4 prior to hydraulic actuation mechanism 5, is effective for smoothly and early starting the operation of both of camshaft-torque actuation mechanism 4 and hydraulic actuation mechanism 5.

This application is based on a prior Japanese Patent Application No. 2006-124955 filed on Apr. 28, 2006. The entire contents of this Japanese Patent Application No. 2006-124955 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A valve timing control apparatus for an internal combustion engine, comprising:

a driving rotator adapted to be rotated by a torque outputted from the internal combustion engine;

a driven rotator arranged to rotate with a relative rotational phase with respect to the driving rotator and adapted to transmit the torque from the driving rotator to a camshaft of the internal combustion engine via working fluid in a torque transmission path;

a camshaft-torque actuation mechanism including at least a first camshaft-torque actuation chamber and a second camshaft-torque actuation chamber arranged in the torque transmission path, the camshaft-torque actuation mechanism being configured to alter the relative rotational phase by providing selectively at least a state of allowing a unidirectional flow of working fluid from the first camshaft-torque actuation chamber to the second camshaft-torque actuation chamber and a state of allowing a unidirectional flow of working fluid from the second camshaft-torque actuation chamber to the first camshaft-torque actuation chamber;

a hydraulic actuation mechanism inducing at least a first hydraulic actuation chamber and a second hydraulic actuation chamber arranged in the torque transmission path, the hydraulic actuation mechanism being configured to alter the relative rotational phase by providing selectively at least a state of supplying working fluid to the first hydraulic actuation chamber from outside and draining working fluid from the second hydraulic actuation chamber to outside and a state of supplying working fluid to the second hydraulic actuation chamber from outside and draining working fluid from the first hydraulic actuation chamber to outside; and a working fluid control section for controlling the camshaft-torque actuation mechanism and the hydraulic actuation mechanism, wherein the working fluid control section comprises:

a first working fluid control section for controlling the camshaft-torque actuation mechanism; and a second working fluid control section for controlling the hydraulic actuation mechanism.

2. The valve timing control apparatus as claimed in claim 1, wherein the first and second working fluid control sections are configured to operate in respective different control modes.

3. The valve timing control apparatus as claimed in claim 1, wherein the first working fluid control section is configured to hold the state of shutting off flow of working fluid of the first and second camshaft-torque actuation chambers when the relative rotational phase is to be held at a position between a most advanced position and a most retarded position, and wherein the second working fluid control section is configured to hold the state of shutting off flow of working fluid of the first and second hydraulic actuation chambers when the relative rotational phase is to be held at a position between the most advanced position and the most retarded position.

4. The valve timing control apparatus as claimed in claim 1, wherein the first working fluid control section is configured to provide selectively at least a state of allowing a unidirectional flow of working fluid from the first camshaft-torque actuation chamber to the second camshaft-torque actuation chamber, a state of allowing a unidirectional flow of working fluid from the second camshaft-torque actuation chamber to the first camshaft-torque actuation chamber, a state shutting off bidirectional flow between the first and second camshaft-torque actuation chambers, and a state of allowing bidirectional flow between the first and second camshaft-torque actuation chambers.

5. The valve timing control apparatus as claimed in claim 4, wherein the second working fluid control section is configured to control the relative rotational phase by feedback control, and wherein the first working fluid control section is configured to provide the state of allowing bidirectional flow between the first and second camshaft-torque actuation chambers while the second working fluid control section is controlling the relative rotational phase by feedback control.

6. The valve timing control apparatus as claimed in claim 1, wherein the second working fluid control section is configured to provide selectively at least a state of supplying working fluid to the first hydraulic actuation chamber from outside and draining working fluid from the second hydraulic actuation chamber to outside, a state of supplying working fluid to the second hydraulic actuation chamber from outside and draining working fluid from the first hydraulic actuation chamber to outside, a state of shutting off flow of working fluid of the first and second hydraulic actuation chambers, and a state of hydraulically connecting the first and second hydraulic actuation chambers to a low pressure section.

7. The valve timing control apparatus as claimed in claim 6, wherein the first working fluid control section is configured to control the relative rotational phase by feedback control, and wherein the second working fluid control section is configured to provide the state of hydraulically connecting the first and second hydraulic actuation chambers to the low pressure section while the first working fluid control section is controlling the relative rotational phase by feedback control.

8. The valve timing control apparatus as claimed in claim 1, wherein, while the first and second working fluid control sections are being de-energized, the relative rotational phase is returned back to a phase value allowing the internal combustion engine to start.

9. The valve timing control apparatus as claimed in claim 8, wherein the first working fluid control section is configured to be de-energized when a failure occurs in the second working fluid control section, and wherein the second working fluid control section is configured to be de-energized when a failure occurs in the first working fluid control section.

10. The valve timing control apparatus as claimed in claim 9, further comprising a warning device for providing warning information when a failure occurs in one of the first and second working fluid control sections.

11. The valve timing control apparatus as claimed in claim 1, wherein the second working fluid control section is configured to start to operate prior to the first working fluid control section when the relative rotational phase is to be altered.

12. The valve timing control apparatus as claimed in claim 1, further comprising a fluid pump adapted to be driven by the internal combustion engine and arranged to supply working fluid to the hydraulic actuation mechanism.

13. The valve timing control apparatus as claimed in claim 1, wherein the camshaft-torque actuation mechanism includes a check valve arranged to allow the unidirectional flow of working fluid.

14. The valve timing control apparatus as claimed in claim 1, wherein the camshaft-torque actuation mechanism includes a replenishing mechanism arranged to replenish the first and second camshaft-torque actuation chambers with an amount of working fluid leaking from the first and second camshaft-torque actuation chambers.

15. The valve timing control apparatus as claimed in claim 14, wherein the replenishing mechanism includes a check valve arranged to allow a unidirectional flow of working fluid to the first and second camshaft-torque actuation chambers.

16. The valve timing control apparatus as claimed in claim 14, wherein the driven rotator is secured to the camshaft by three bolts, and wherein a passage of the replenishing mechanism, a passage leading to the first camshaft-torque actuation chamber, and a passage leading to the second camshaft-torque actuation chamber, are arranged alternately with the three bolts in a circumferential direction.

17. The valve timing control apparatus as claimed in claim 1, further comprising a phase lock mechanism arranged to lock, at start of the internal combustion engine, the relative rotational phase at a phase value allowing the internal combustion engine to start.

18. The valve timing control apparatus as claimed in claim 1, wherein:

the first working fluid control section is disposed within one of the camshaft and the driven rotator; and the second working fluid control section is disposed in a position separate from the first working fluid control section.

19. The valve timing control apparatus as claimed in claim 1, wherein:

the first working fluid control section is configured to operate independently of the second working fluid control section, and the second working fluid control section is configured to operate independently of the first working fluid control section.

20. The valve timing control apparatus as claimed in claim 19, wherein the first working fluid control section is configured to operate in a first control mode to control the camshaft-torque actuation mechanism to generate a first torque to alter the relative rotational phase in a first rotational direction, and wherein the second working fluid control section is configured to control the hydraulic actuation mechanism to generate a second torque to alter the relative rotational phase in a second rotational direction during the first control mode of the first working fluid control section, the second torque being different in magnitude than the first torque, and the second rotational direction being opposite to the first rotational direction.

21. The valve timing control apparatus as claimed in claim 20, wherein the first working fluid control section is configured to operate in the first control mode at low speed operation of the internal combustion engine, the first torque being larger than the second torque.

22. A valve timing control apparatus for an internal combustion engine, comprising:

a driving rotator adapted to be rotated by a torque outputted from the internal combustion engine;

a driven rotator arranged to rotate with a relative rotational phase with respect to the driving rotator and adapted to transmit the torque from the driving rotator to a camshaft of the internal combustion engine via working fluid in a torque transmission path;

at least a first camshaft-torque actuation chamber and a second camshaft-torque actuation chamber arranged in the torque transmission path;

a camshaft-torque actuation control valve configured to alter the relative rotational phase by providing selectively at least a state of allowing a unidirectional flow of working fluid from the first camshaft-torque actuation chamber to the second camshaft-torque actuation chamber and a state of allowing a unidirectional flow of working fluid from the second camshaft-torque actuation chamber to the first camshaft-torque actuation chamber;

at least a first hydraulic actuation chamber and a second hydraulic actuation chamber arranged in the torque transmission path;

a hydraulic actuation control valve configured to alter the relative rotational phase by providing selectively at least a state of supplying working fluid to the first hydraulic actuation chamber from outside and draining working fluid from the second hydraulic actuation chamber to outside and a state of supplying working fluid to the second hydraulic actuation chamber from outside and draining working fluid from the first hydraulic actuation chamber to outside; and a controller for controlling the camshaft-torque actuation control valve and the hydraulic actuation control valve independently of each other.

23. The valve timing control apparatus as claimed in claim 1, wherein the driving rotator is adapted to be driven by a crankshaft of the internal combustion engine.

* * * * *